US010422175B2

(12) United States Patent
Bacchetti

(10) Patent No.: US 10,422,175 B2
(45) Date of Patent: Sep. 24, 2019

(54) LOW-BULKINESS HINGE

(71) Applicant: IN & TEC S.R.L., Brescia (IT)

(72) Inventor: Luciano Bacchetti, Nave (IT)

( * ) Notice: Subject to any disclaimer, the term of this patent is extended or adjusted under 35 U.S.C. 154(b) by 61 days.

(21) Appl. No.: 15/572,468

(22) PCT Filed: May 18, 2016

(86) PCT No.: PCT/IB2016/052890

§ 371 (c)(1),
(2) Date: Nov. 7, 2017

(87) PCT Pub. No.: WO2016/185394

PCT Pub. Date: Nov. 24, 2016

(65) Prior Publication Data

US 2018/0283073 A1 Oct. 4, 2018

(30) Foreign Application Priority Data

May 18, 2015 (IT) ..... 102015000015573
May 18, 2015 (IT) ..... 102015000015578
(Continued)

(51) Int. Cl.
*E05F 1/12* (2006.01)
*E05F 3/10* (2006.01)
(Continued)

(52) U.S. Cl.
CPC ..... *E05F 1/1253* (2013.01); *E05D 5/0246* (2013.01); *E05D 7/081* (2013.01);
(Continued)

(58) Field of Classification Search
CPC ..... E05F 3/104; E05F 3/10; E05F 3/20; E05F 1/1253; E05F 1/105; E05D 7/086; E05D 5/0246; E05D 7/081
See application file for complete search history.

(56) References Cited

U.S. PATENT DOCUMENTS 1,603,823 A * 10/1926 Willard ..... E05F 1/1253 16/284
1,653,448 A * 12/1927 Bommer ..... E05D 11/1064 16/284
(Continued)

FOREIGN PATENT DOCUMENTS

DE 29507176 8/1995
EP 2333212 6/2011
(Continued)

*Primary Examiner* — Jeffrey O'Brien
(74) *Attorney, Agent, or Firm* — Themis Law

(57) ABSTRACT

A hinge for cold rooms or glass shutters, coupling a stationary support structure and a shutter movable between an open position and a shutter position, includes a hinge body having a working chamber; a pivot defining a first longitudinal axis coupled to the hinge body to rotate around the first axis between the open and the closed shutter position; a cam element integral with the pivot; a plunger element sliding in the working chamber along a second axis substantially perpendicular to the first axis, the plunger element having a slider with an operative face interacting with the cam element; and an elastic counteracting member acting upon the plunger element to move it along the second axis between a position proximal to the bottom wall of the working chamber and a position distal therefrom. The hinge body has a substantially plate shape.

20 Claims, 30 Drawing Sheets

(30) Foreign Application Priority Data

May 18, 2015 (IT) ..... 102015000015583
May 18, 2015 (IT) ..... 102015000015588

(51) Int. Cl.

| | |
|---|---|
| ***E05D 5/02*** | (2006.01) |
| ***E05D 7/10*** | (2006.01) |
| ***E05F 1/10*** | (2006.01) |
| ***E05F 3/20*** | (2006.01) |
| ***E05D 7/081*** | (2006.01) |
| *E05D 5/10* | (2006.01) |
| *E05D 11/04* | (2006.01) |

(52) U.S. Cl.

CPC ..... *E05D 7/1016* (2013.01); *E05F 1/105* (2013.01); *E05F 3/104* (2013.01); *E05F 3/20* (2013.01); *E05D 2005/106* (2013.01); *E05D 2011/045* (2013.01); *E05Y 2201/10* (2013.01); *E05Y 2201/638* (2013.01); *E05Y 2201/706* (2013.01); *E05Y 2600/502* (2013.01); *E05Y 2800/672* (2013.01); *E05Y 2900/102* (2013.01); *E05Y 2900/132* (2013.01); *E05Y 2900/146* (2013.01)

(56) References Cited

U.S. PATENT DOCUMENTS 2,035,823 A * 3/1936 Moore ..... E05D 11/1064 16/200
4,847,946 A * 7/1989 Nam ..... E05F 3/102 16/53
7,305,796 B2 * 12/2007 Chiang ..... E05D 5/0246 16/252
7,305,797 B2 * 12/2007 Chiang ..... E05D 5/0246 16/252
7,673,373 B2 * 3/2010 Chang ..... E05D 5/0246 16/250
8,191,206 B1 * 6/2012 Bacchetti ..... E05D 11/1014 16/378
8,443,487 B2 * 5/2013 Bacchetti ..... E05F 3/104 16/51
8,528,169 B1 * 9/2013 Yu ..... E05D 7/043 16/238
8,677,560 B2 * 3/2014 Bacchetti ..... E05F 3/104 16/51
8,863,356 B2 * 10/2014 Bacchetti ..... E05F 3/104 16/54
8,938,912 B2 * 1/2015 McKibben ..... E05F 1/105 49/138
8,984,717 B1 * 3/2015 Jackson ..... E05F 1/1253 16/273
9,074,399 B2 * 7/2015 Cheng ..... E05F 3/104
9,095,214 B2 * 8/2015 White ..... E05F 1/1253
9,644,410 B2 * 5/2017 Hayes ..... E05D 5/0246
9,702,177 B2 * 7/2017 Bacchetti ..... E05F 3/10
9,810,012 B2 * 11/2017 Bacchetti ..... E05F 3/10
9,926,733 B2 * 3/2018 Bacchetti ..... E05F 3/10
10,151,129 B2 * 12/2018 Bacchetti ..... E05F 3/10
2004/0206007 A1 * 10/2004 Chiang ..... E05D 5/0246 49/388
2010/0024159 A1 * 2/2010 Oh ..... E05D 5/0246 16/54

FOREIGN PATENT DOCUMENTS

| | | |
|---|---|---|
| FR | 1065109 | 5/1954 |
| KR | 2010006102 | 6/2010 |
| WO | 2011016000 | 2/2011 |

* cited by examiner

LOW-BULKINESS HINGE

FIELD OF THE INVENTION

The present invention is generally applicable to the technical field of hinges for doors, shutter or the like, and it particularly relates to a low-bulkiness hinge.

BACKGROUND OF THE INVENTION

As known, hinges generally comprise a movable element, usually fixed to a door, a shutter or the like, pivoted on a stationary element, usually fixed to the support frame thereof.

In particular, the hinges usually used in cold rooms or glass shutters are bulky, unaestethic and not very functional.

From documents U.S. Pat. No. 7,305,797, US2004/206007 and EP1997994 hinges are known wherein the action of the closing means that ensure the return of the shutter in the closed position is undisputed. Consequently, there is the risk that the shutter strongly impacts against the support frame, thus damaging itself.

From documents EP0407150 and FR2320409 door closers are known that include hydraulic damping means to counteract the action of the closing means. Such known devices are extremely bulky and, consequently, have to be necessarily mounted on the floor.

Therefore, the installation of such devices necessarily requires expensive and difficult breaking works of the floor, that have to be made by specialized personnel.

Therefore, it is evident that such door closer is not suitable to be mounted on the stationary support structure or in the shutter of the cold rooms.

From the German patent DE3641214 an automatic closing device is known for window shutters suitable to be mounted externally thereto.

SUMMARY OF THE INVENTION

Object of the present invention is to at least partially overcome the above mentioned drawbacks, by providing a hinge having features of high functionality, constructional simplicity and low cost.

Another object of the invention is to provide an extremely low-bulkiness hinge.

Another object of the invention is to provide a hinge that may be interposed between the shutter and the frame of the stationary support structure of a cold room.

Another object of the invention is to provide a hinge that ensures the automatic closing of the door from the open door position.

Another object of the invention is to provide a hinge that ensures the controlled movement of the door to which it is bound, both upon the opening and the closing.

Another object of the invention is to provide a hinge that is suitable to support also very heavy doors and frames, without changing the behaviour and without adjustments.

Another object of the invention is to provide a hinge that has a minimum number of constituent parts.

Another object of the invention is to provide a hinge suitable to maintain the exact closing position through time.

Another object of the invention is to provide an extremely safe hinge, that, if pulled, does not resist to the closing.

Another object of the invention is to provide a hinge extremely easy to install.

Such objects, as well as others which will appear more clearly hereinafter, are fulfilled by a hinge according to what is herein described, shown and/or claimed.

Advantageous embodiments of the invention are defined in accordance with the appended claims.

BRIEF DESCRIPTION OF THE DRAWINGS

Further features and advantages of the invention will become more evident by reading the detailed description of some preferred but not exclusive embodiments of a hinge 1, shown by way of non-limiting example with the help of the annexed drawing, wherein.

DETAILED DESCRIPTION OF SOME PREFERRED EMBODIMENTS

With reference to the above mentioned figures, the hinge according to the invention, globally indicated with the number 1, has low bulkiness and, therefore, it is advantageously used in applications wherein the space to insert the hinge is limited or where for aesthetic reasons it is suitable to use a low-bulkiness hinge.

For example, the hinge 1 may be applicable to cold rooms, or it may be integrated in the tubular frame thereof. In a further example, the hinge 1 may be applicable to glass shutters, such as those of a showcase or display cabinet.

Figure 5A:
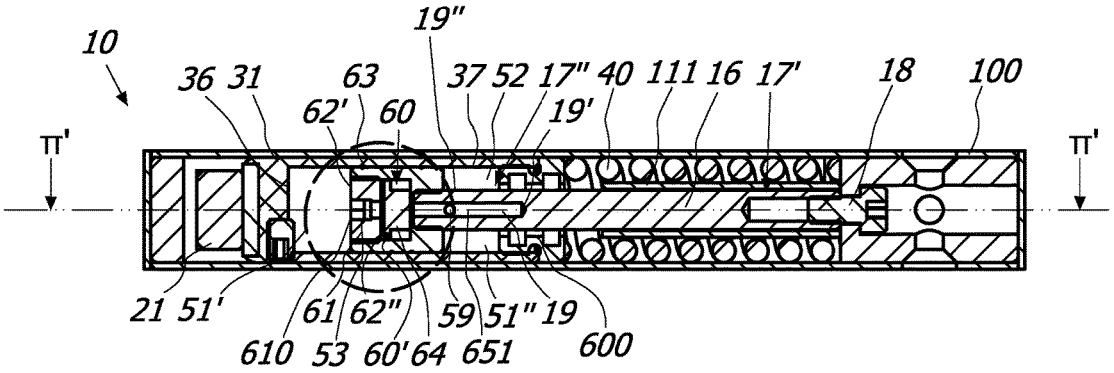
FIGS. 5*a* and 5*b* are section axial and radial views with respect to the pivot 20 of the first embodiment of the hinge 1 of FIG. 1 with the shutter A closed.
Figure 5B:
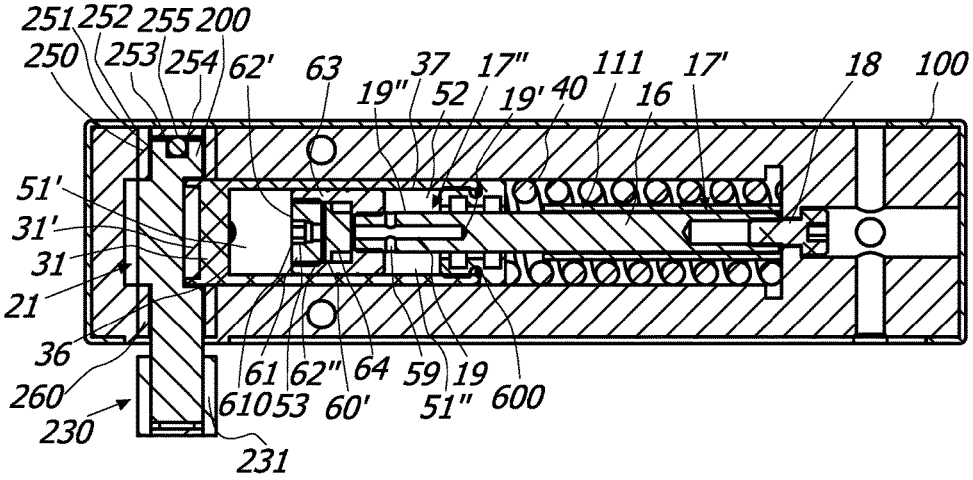
Figure 7A:
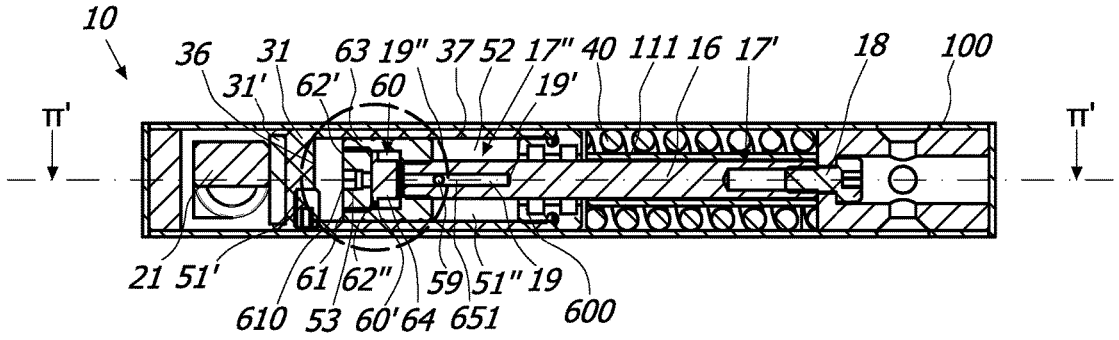
FIGS. 7*a* and 7*b* are section axial and radial views with respect to the pivot 20 of the first embodiment of the hinge 1 of FIG. 1 with the shutter A open at 90°.
Figure 8A:
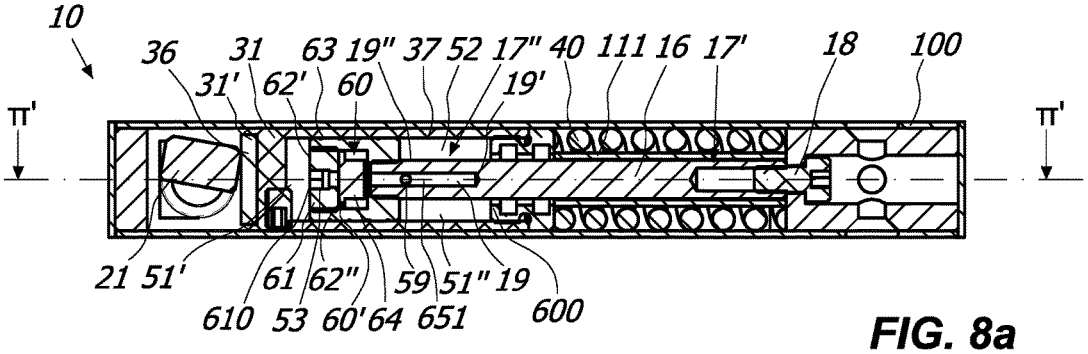
FIGS. 8*a* and 8*b* are section axial and radial views with respect to the pivot 20 of the first embodiment of the hinge 1 of FIG. 1 with the shutter A open over 90°.
Figure 8B:
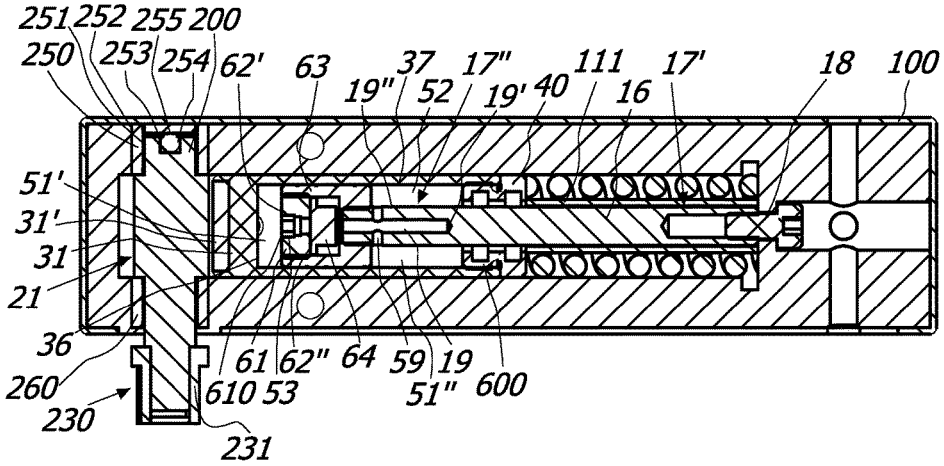
Figure 9:
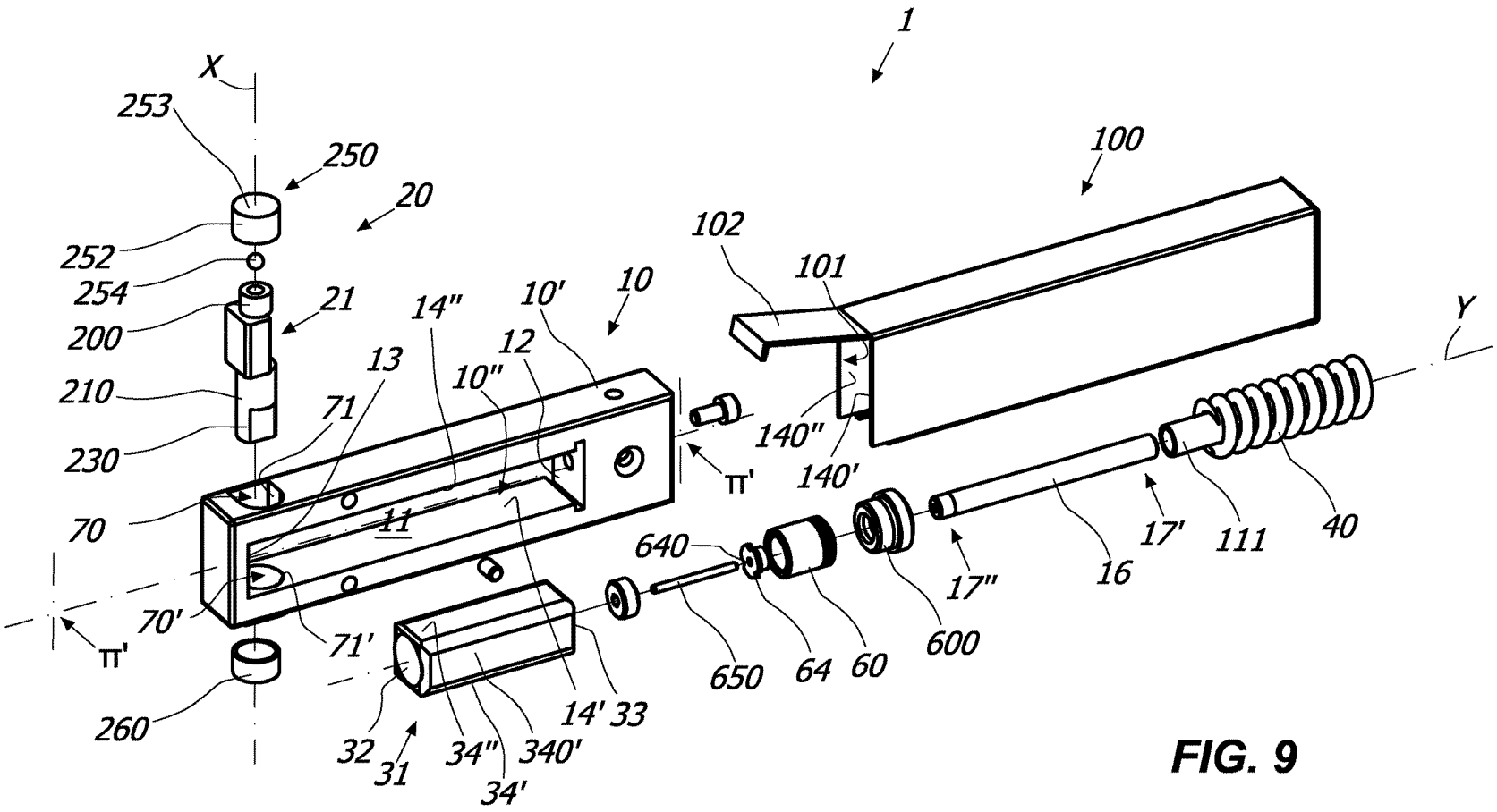
FIG. 9 is an exploded axonometric view of a second embodiment of the hinge 1.
Figure 10:
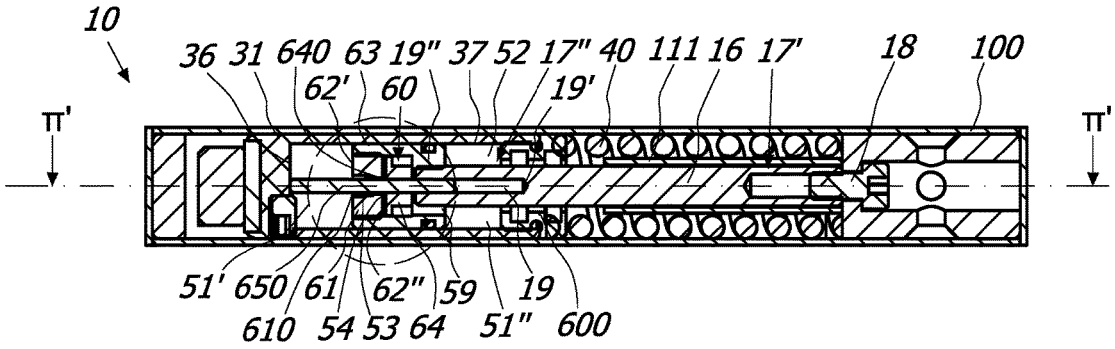
FIGS. 10 and 11 are section axial and radial views with respect to the pivot 20 of the embodiment of the hinge 1 of FIG. 9 with the shutter A closed.
Figure 11:
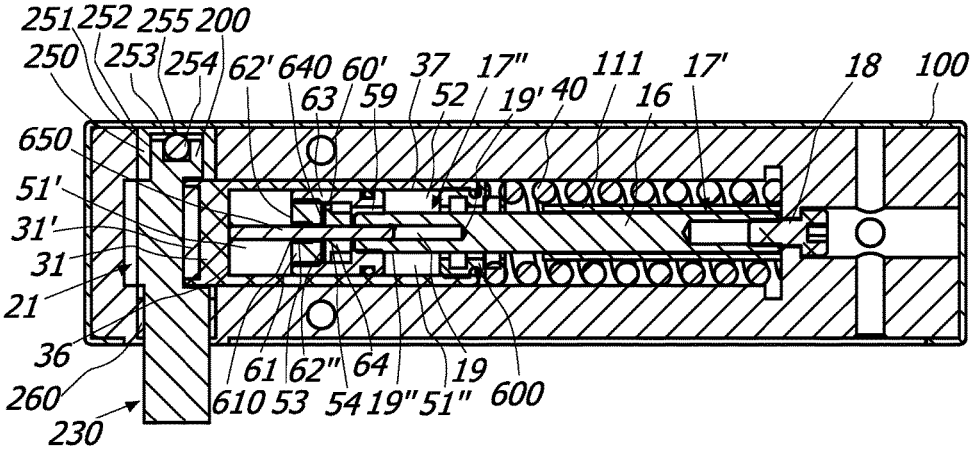
Figure 12A:
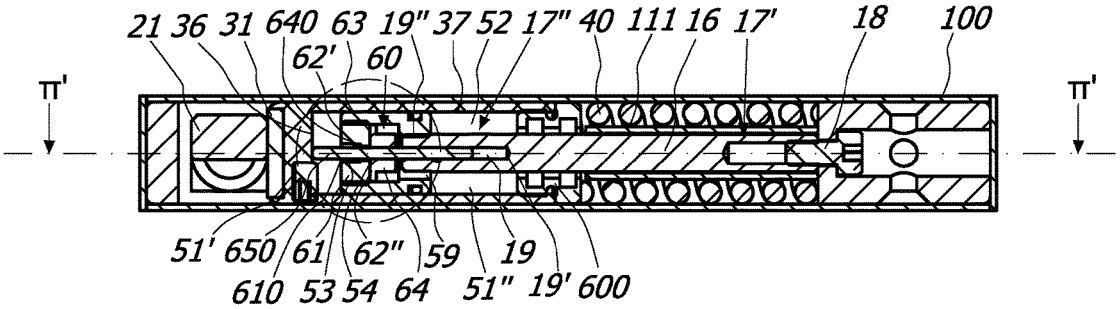
FIGS. 12*a* and 12*b* are section axial and radial views with respect to the pivot 20 of the embodiment of the hinge 1 of FIG. 9 with the shutter A open at 90°.
Figure 12B:
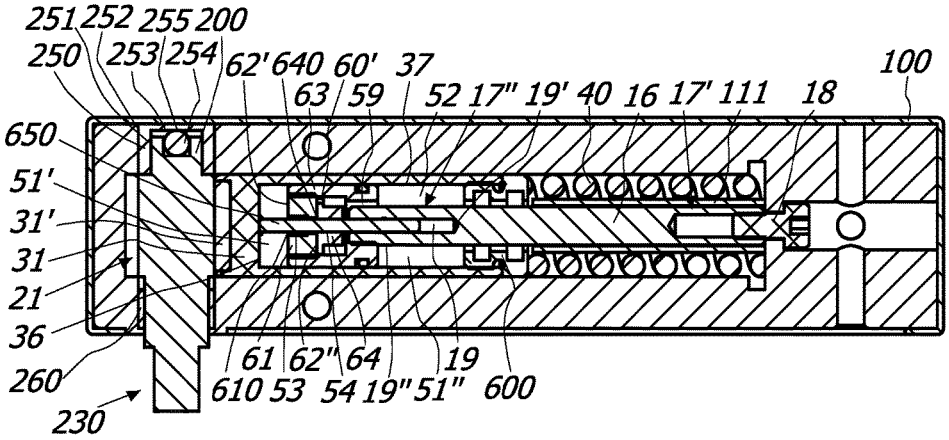
Figure 13A:
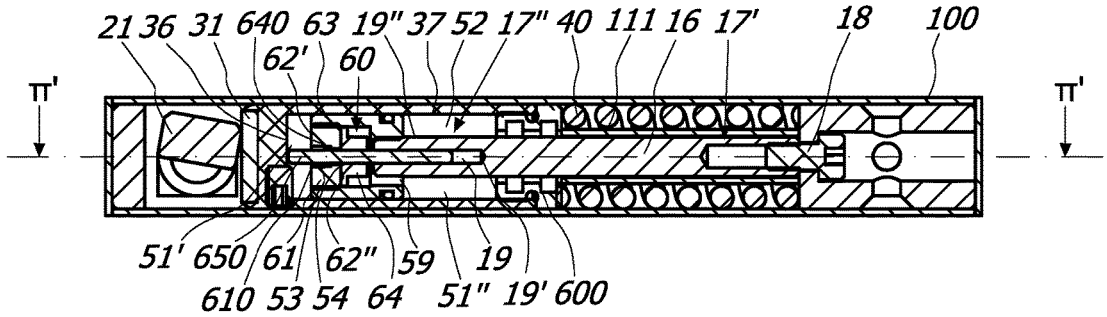
FIGS. 13*a* and 13*b* are section axial and radial views with respect to the pivot 20 of the embodiment of the hinge 1 of FIG. 9 with the shutter A open over 90°.
Figure 13B:
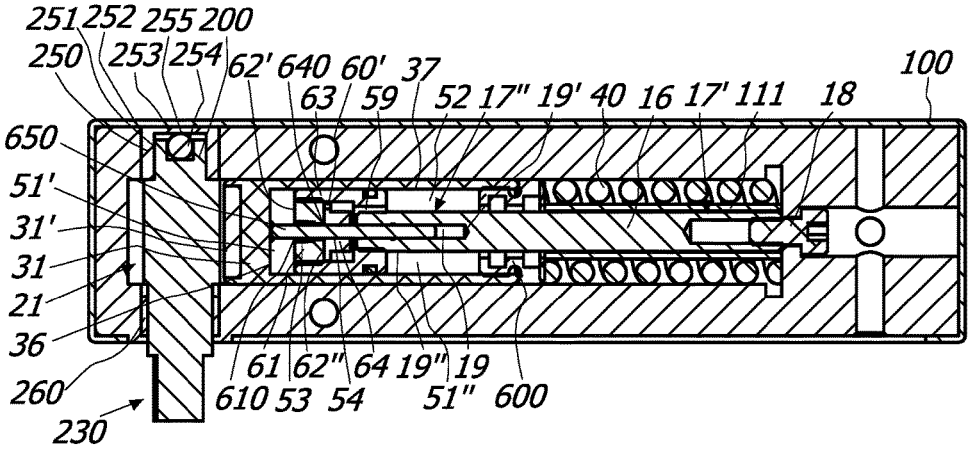

In general, the hinge 1 is suitable to rotatably couple a stationary support structure, such as a tubular frame S, and a closing member, for example a shutter A, rotatably movable between an open position, shown for example in FIGS. 7*a* and 8*b*, and a closed one, shown for example in FIGS. 5*a* and 5*b*, around a rotation axis X.

It is understood that even though hereinafter we refer to the frame S and to the shutter A, the hinge 1 is applicable to any stationary support structure and to any frame without departing from the scope of the appended claims.

Suitably, the hinge 1 may include a hinge body 10 of substantially plate shape defining a plane π' and a pivot 20 defining the rotation axis X.

In a preferred but not exclusive embodiment, the hinge body 10 may be anchored to the shutter A and the pivot 20 to the frame S. In this case, the fixed element includes the pivot 20, while the movable element may include the hinge body 10.

Suitably, once the hinge body 10 is anchored to the shutter A, the plane π' defined by the former may be coincident or parallel to the plane π defined by the latter.

Viceversa, the hinge body 10 may be anchored to the frame S, while the pivot 20 may be anchored to the shutter A, without thereby departing from the scope of the appended claims. In this case, the fixed element includes the hinge body 10, while the movable element may include the pivot 20.

Advantageously, the hinge body 10 and the pivot 20 may be reciprocally coupled to rotate around the axis X between the open and closed shutter A positions.

Suitably, the pivot 20 may include a cam element 21 integral therewith interacting with a plunger element 30 sliding along an axis Y.

The sliding axis Y of the plunger element 30 may be substantially perpendicular to the axis X. Furthermore, the axis X of rotation of the shutter A may be substantially parallel to the plane π' or lying thereon.

Figure 7B:
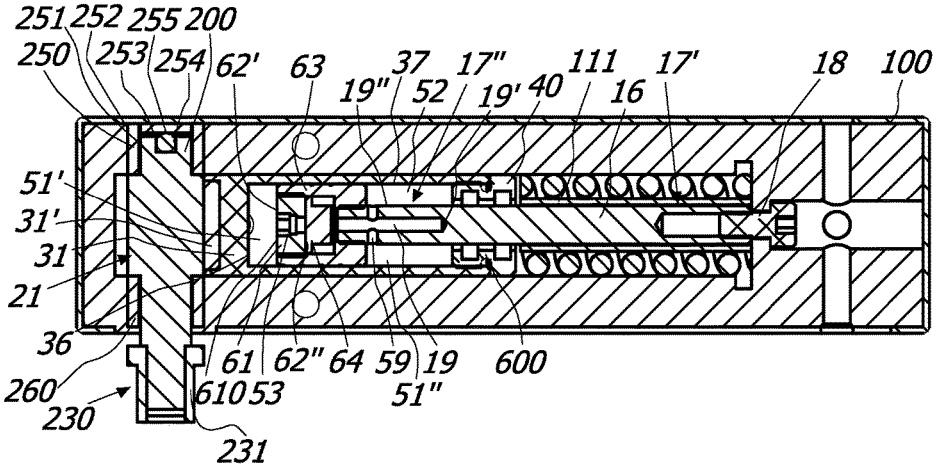

In any case the plunger element 30, that may include, respectively, consist of, a slider 31, may slide in a working chamber 11 inside the hinge body 10 between a retracted end stroke position proximal to the bottom wall 12 of the working chamber 11, shown for example in FIGS. 7*a* and 7*b*, and an extended end stroke position distal therefrom, shown for example in FIGS. 5*a* and 5*b*.

Suitably, such retracted and extended end stroke positions may be any, and they may not necessarily correspond to the maximum distal and/or proximal position o that the plunger element 30 may assume.

In a preferred but not exclusive embodiment of the invention, the working chamber 11 may include counteracting elastic means acting upon the slider 31 to move it along the proximal and distal positions.

In a preferred but not exclusive embodiment, the elastic counteracting means may include, respectively, may consist of, a coil spring 40 of predetermined diameter.

Depending on the configuration, the elastic counteracting means 40 may be of thrust or restore.

In case of thrust elastic counteracting means, the strength thereof is such to automatically return the shutter A from the open or closed position that it reaches when the slider 31 is in the proximal position towards the other of the open or closed position that it reaches when the slider 31 is in the distal position.

In this case, depending on whether the position reached by the shutter A when the slider 31 is in the proximal position is open or closed, the hinge 1 is an opening hinge or a closing hinge or a door closer hinge.

Conversely, in case of restore counteracting elastic means, the strength thereof is such not to able to push the shutter A from the open or closed position that it reaches when the slider 31 is in the proximal position towards the other of the open or closed position that it reaches when the slider 31 is in the distal position. In this case, the shutter A has to be moved manually or with actuating means external to the hinge 1, for example a motor.

However, the strength of the restore elastic means is such to move back the slider 31 from the proximal to the distal position.

In this case, depending on whether the position reached by the shutter A when the slider 31 is in the proximal position is open or closed, the hinge 1 is a control hinge upon the opening or the closing.

It is evident that the closing or opening hinge further acts as control upon the opening or the closing, while the opposite is not true.

It is understood that although in the annexed figures it is shown a closing hinge 1 the same hinge may be a closing or opening hinge, as well as a controlling hinge upon the opening or the closing without departing from the scope of the appended claims.

In a preferred but not exclusive embodiment, the working chamber 11 may further include a rod 16 defining the axis Y. In this case, the elastic counteracting means may include, respectively, consist of, a coil spring 40 fitted on the rod 16, that acts as guide thereof.

Possibly, the spring 40 may be guided by the side walls of the working chamber 11 during the sliding thereof along the axis Y, with or without the guiding rod 16.

Preferably, the elastic counteracting means may consist of a single coil spring 40, that may be a thrust or restore spring. In other words, the coil spring 40 may be the only elastic counteracting means of the hinge.

Once the coil spring 40 is inserted on the rod 16, the spring 40 thereof remains interposed between the bottom wall 12 of the chamber 11 and the rear face 33 of the slider 31, that acts as abutment face for the spring 40 thereof.

The hinge 1 may have both vertical and horizontal low bulkiness. The spring 40 may have an outer diameter Øe equal to or slightly lower than the thickness h of the hinge body 10.

Suitably, such thickness h may be substantially equal to or slightly greater than that of the slider 31. Indicatively, such thickness h may be lower than 30 mm, and preferably lower than 25 mm and even more preferably lower than 20 mm.

Figure 33A:
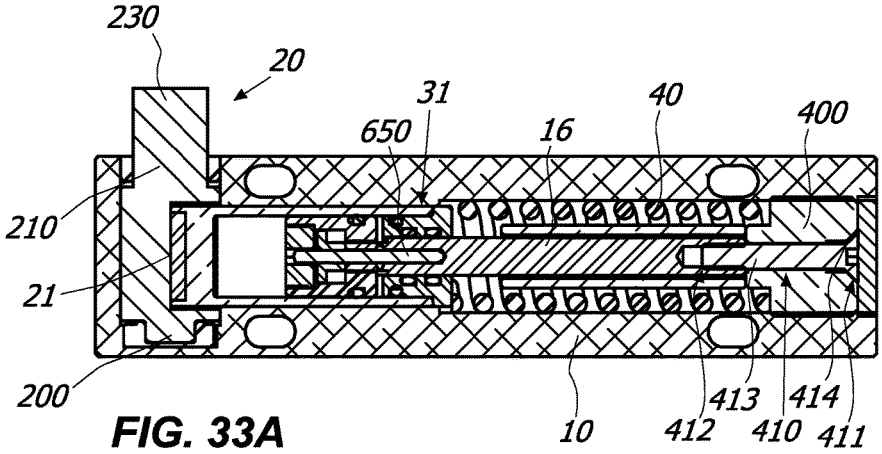
FIGS. 33*a* and 33*b* are section axial views with respect to the pivot 20 of the embodiment of the hinge 1 of FIG. 32 respectively with the shutter A closed and open at 90°.
Figure 33B:
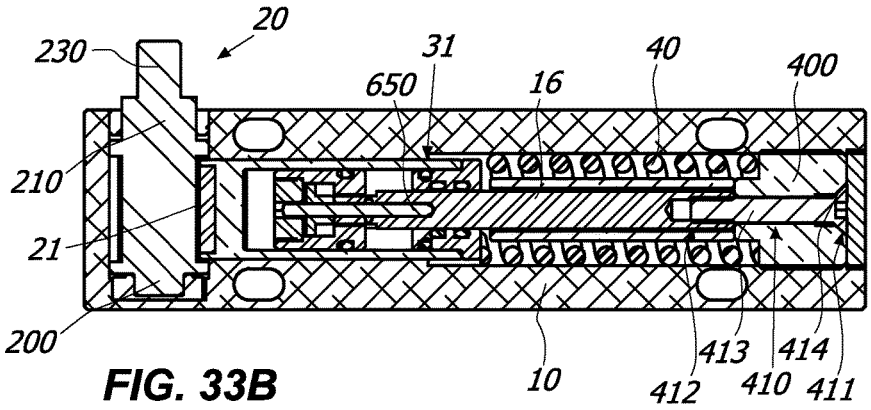

Moreover, the spring 40 may have an inner diameter Øi substantially equal to or slightly greater than the diameter of the support rod 16 whereon it is inserted. On the other hand, the inner diameter Øi of the spring 40 is appreciably greater than that of the rod 16, such as shown in FIGS. 33A and 33B.

Advantageously, the slider 31 may comprise an axial blind hole 35 suitable to house the rod 16, so as the former slides along the axis Y with respect to the latter between the distal and proximal positions.

More particularly, the rod 16 may include a first end 17' operatively coupled to the bottom wall 12 of the chamber 11, for example by screw means 18, and a second end 17" inserted in the axial blind hole 35 to remain faced to the bottom wall 36 of the latter.

Thanks to such a configuration, the hinge 1 is extremely simple and quick to assemble. In fact, once the spring 40 is fitted on the rod 16 and the latter is inserted in the axial blind hole 35 of the slider 31 it is sufficient to insert such an assembly in the working chamber 11, to screw the rod 16 to the bottom wall 12 by means of the screw means 18 and, then, to insert the cam element 21 in the hinge body 10.

In a preferred but not exclusive embodiment, the screw means 18 may be directly screwed on the rod 16 by means of an abutment plate 18' of the spring 40. This maximally simplifies the assembly of the hinge. In fact, once the spring 40 is fitted on the rod 16, the spring 40 thereof is blocked by the plate 18' and such an assembly is inserted from the top into the chamber 11.

Advantageously, the slider 31 may have substantially a plate shape to define a plane π" substantially coincident with the plane π' defined by the hinge body 10.

Suitably, the slider 31 may be guided by the walls of the working chamber 11 during the sliding thereof along the axis Y.

Preferably, the slider 31 may have a substantially parallelepiped shape with the operative face 32 facing the front wall 13 of the working chamber 11, the rear face 33 facing the bottom wall 12 of the chamber 11 and side faces 34', 34" facing and preferably in contact with the side walls 14', 14" of the chamber 11 thereof. In this way, the latter act as as guides for the slider 31.

To contain the costs of the hinge, the slider 31 may include an insert 31' whereto the operative face 32 belongs. The slider 31 may be made of a first metallic material, for example aluminium, or of a polymeric material, while the insert 31' may be made of a second metallic material harder than the first, for example steel. In this way, it is possible to realize only the parts actually in contact with the cam element 21 in the "hard" and more expensive material, while the remaining part of the slider 31 may be made of a cheaper material.

Suitably, moreover, the working chamber 11 may further have a pair of shaped facing walls 140', 140" interacting with a respective pair of opposite counter-shaped walls 340', 340" of the slider 31.

Suitably, the faced walls 140', 140" may be defined by the inner surface 101 of a closing element 100 of the hinge 1, whose function is better explained hereinafter. Preferably, one or a pair of covers 82, 83 may be placed on the closing element 100 with aesthetic and/or protective function.

Preferably, the shaped facing walls 140', 140" may have a flat shape, as the opposite walls 340', 340", and they may preferably be in reciprocal contact with the latter so as to guide them during the sliding of the slider 31 along the axis Y.

In a preferred but not exclusive embodiment, the walls 14', 14" and 34', 34" may be substantially parallel, as the walls 140', 140" and 340', 340". Preferably, moreover, the walls 14', 14" and 34', 34" may be substantially perpendicular to the plane π' defined by the hinge body 10, while the walls 140', 140" and 340', 340" may be substantially parallel to the plane π' defined by the hinge body 10.

In a preferred but not exclusive embodiment, shown for example in FIGS. 1 to 18*b*, the cam element 21 of the pivot 20 may have a substantially parallelepiped shape with a first surface 23 susceptible to come in contact with the operative face 32 of the slider 31 when the same slider is in the distal position and a second surface 24 susceptible to come in contact with the operative face 32 of the slider 31 when the same slider is in the proximal position.

Advantageously, both the two surfaces 23 and 24 and the operative face 32 may be substantially flat or slightly curved.

The angle between the two surfaces 23 and 24 may be any, and it determines the opening angle of the shutter A.

Suitably, the two surfaces 23 and 24 may be substantially perpendicular to each other. In this case, when the slider 31 is in the proximal position the first and the second surface 23 and 24 may be respectively substantially perpendicular and parallel to the operative face 32, while when the slider 31 is in the distal position the first and the second surface 23 and 24 may be respectively substantially parallel and perpendicular to the operative face 32 thereof.

Preferably, the second surface 24 of the cam element 21 may include a shock-absorbing portion 25 susceptible to interact with the slider 31 to slightly compress the coil spring 40 from the position of maximum compression in case the user further rotates the glass shutter to open it.

In this way, the coil spring 40 shock-absorbs the further rotary movement imparted by the user, by preventing the damage of the hinge and/or of the glass shutter.

Suitably, the shock-absorbing portion 25 may be interposed between the second surface 24 and a third surface 26 substantially perpendicular thereto and substantially parallel to the first surface 23.

To block the rotation of the shutter A, the hinge 1 may further include an abutment portion suitable to come in contact with the slider 31 when the user further rotates the shutter A thereof, as particularly shown for example in FIGS. 8*a* and 8*b*.

Suitably, such an abutment portion may be defined by the portions 110', 110" of the hinge body 10.

On the other hand, a tubular element 111 may be provided fitted on the rod 16 to remain interposed between the latter and the coil spring 40 that has a length such as to impact against the rear face 33 of the slider 31.

To minimize the bulkiness of the hinge 1, the cam element 21 may have a width L such that when the slider 31 is in the distal position the cam element 21 thereof is oriented so as to occupy a major portion of the thickness h of the hinge body 10 and that when the slider 31 is in the proximal position, the cam element 21 is rotated substantially of 90° in order to occupy a reduced portion of the thickness h of the hinge body 10.

The major portion occupied by the cam element 21 when the slider 31 is in the distal position may have a width L, that naturally coincides with that of the cam element 21, such that when the pivot 20 rotates around the axis X the cam element 21 thereof substantially occupies all the thickness h of the hinge body 10. In other words, the edges of the cam element 21, for example the shock-absorbing portion 25, pass very close to the side walls 140', 140", up to brush them.

In this way, it is possible to maximally exploit the little space available for the rotation of the pivot 20.

To allow the insertion of the pivot 20 in the hinge body 10, the latter may include a passing-through elongated slot 70, that may be dimensioned so as to allow the passage of the pivot 20 exclusively when the cam element 21 is rotated substantially of 90°.

On the other hand, once the pivot 20 has been inserted in the working chamber 11, the cam element 21 may be rotated in the position wherein it occupies the major portion of the thickness h of the hinge body 10.

In such a position, the cam element 21 may be susceptible to impact against the hinge body 10, so as to avoid the reciprocal slippage.

Figure 1:
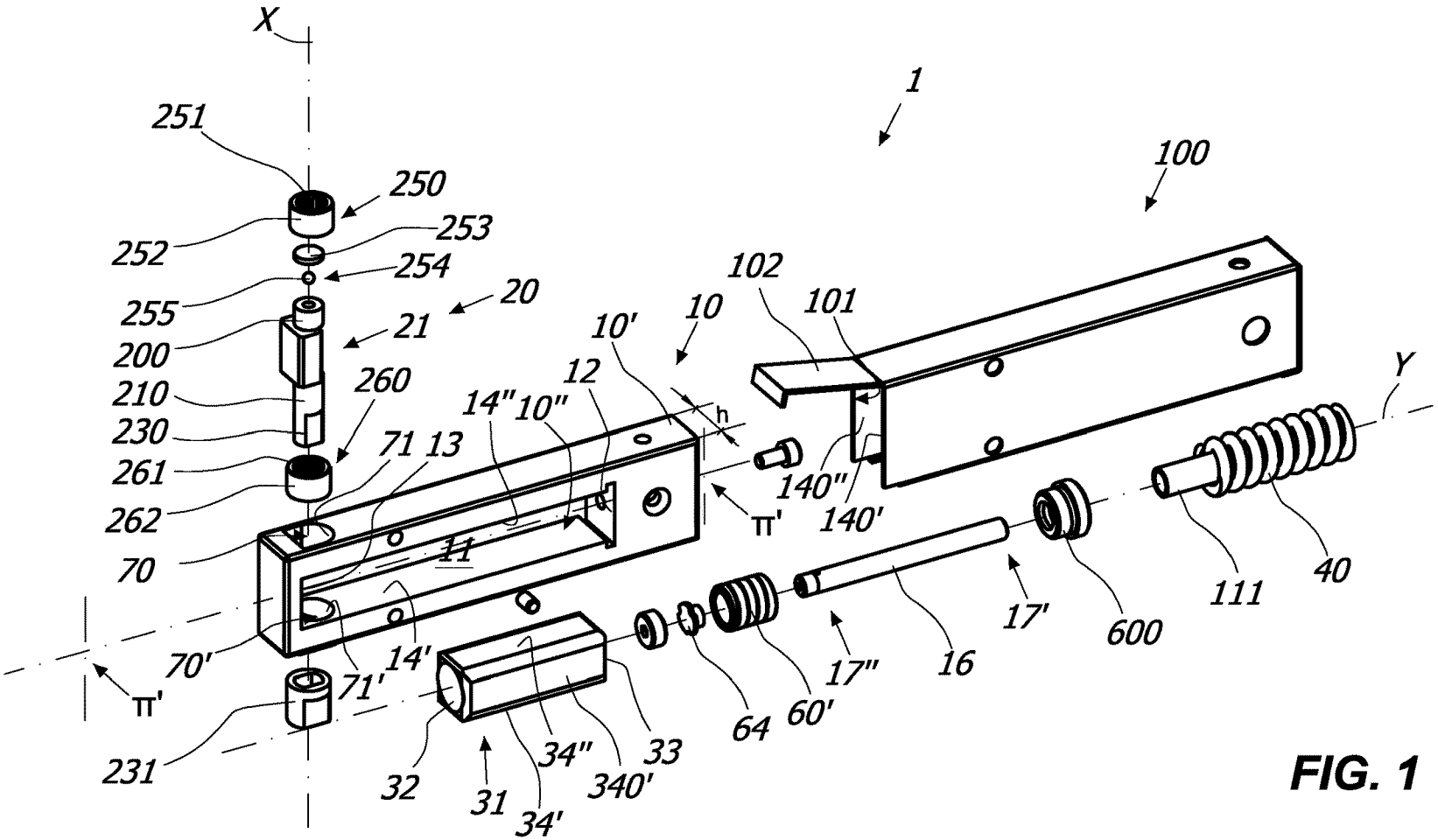
FIG. 1 is an exploded axonometric view of a first embodiment of the hinge 1.

On the other hand, as shown for example in FIG. 1, the hinge body 10 may include two passing-through slots 70, 70'. Such an embodiment is simpler to implement, since it only requires a drilling with a vertical drill and a punching with a square punching die for the slot 70. Even in such a case the pivot 20 may be inserted as above mentioned.

Once inserted into the hinge body 10, the pivot 20 has an operative portion that coincides with the cam element 21 inside the working chamber 11 and a fastening portion 230 that protrudes from the hinge body 10.

In a further preferred but not exclusive embodiment, shown for example in FIGS. 22 to 26, the cam element 21 may be realized according to the teachings of the international application PCT/IB2007/051663, to which reference is made for consultation.

Due to the limited space available, the hinge 1 may be devoid of the classical thrust bearings.

However, alternative anti-friction and thrust means may be provided especially configured to perform their function in the very limited space available.

In particular, such anti-friction and thrust means may be placed in correspondence of the anchoring areas 210, 200 of the pivot 20 to the hinge body 10, that may remain faced to the passing-through slot 70' and to the seat 70. In the embodiment with two slots, the latter coincides with the other slot 70.

Suitably, the distance d between the first and the second anchoring areas 200, 210 may be substantially equal to the height of the cam element 21. In this way, even the vertical bulkiness of the pivot 20 is minimized.

In a preferred but not exclusive embodiment, the hinge body 10 may include a first and a second annular element 250, 260 inserted in the seat 70 and in the slot 70' to come in contact with the first and the second anchoring area 200, 210 of the pivot 20.

More particularly, the first and second annular elements 250, 260 include respective inner surfaces 251, 261 susceptible to come in contact respectively with the first and the second anchoring area 200, 210 of the pivot 20.

In this way, the latter is axially and/or radially blocked, so as to counteract the thrust of the coil spring 40 and/or to avoid the misalignment.

Suitably, the first and the second annular element 250, 260 may be inserted in the seat 70 and in the slot 70' in a removable manner.

More particularly, the first and the second removable annular element 250, 260 may include respective outer surfaces 252, 262 susceptible to come in contact with the inner surfaces 71, 71' of the seat 70 and of the slot 70'.

In a preferred but not exclusive embodiment, the annular element 250 may include a bottom wall 253 substantially perpendicular to the plane π'. Such a bottom wall 253 may be monolithic with the annular element 250, as shown for example in FIG. 9, or detachable therefrom, as shown for example in FIG. 1.

The anchoring area 200 of the pivot 20 may include an anti-friction element in contact with the bottom wall 253, which may be defined by a ball 254 having a curved surface 255 that is in contact both with the pivot 20 and with the bottom wall 253.

On the other hand, the anchoring area 200 may include the curved surface in contact with the bottom wall 253.

Suitably, the first and second annular elements 250, 260 may include further anti-friction elements 320 interposed between the respective outer surfaces 252, 262 and the inner surfaces 71, 71' of the seat 70 and the slot 70'.

For example, such anti-friction elements 320 may be respective series of cylindrical rollers. Thanks to such a configuration, it is possible to effectively prevent the misalignment of the shutter A.

Figure 25A:
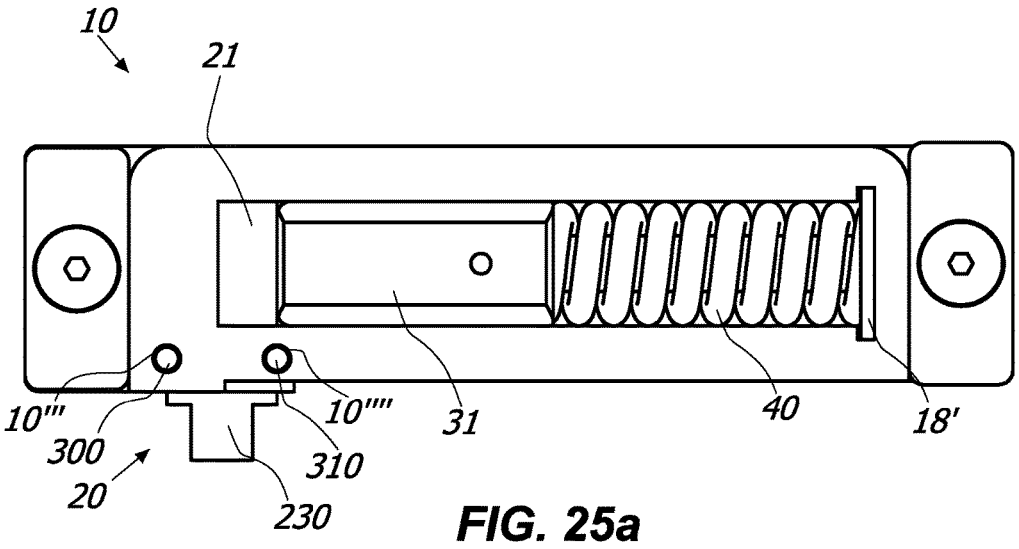
FIGS. 25*a* and 25*b* are respectively side and section radial views with respect to the pivot 20 of the embodiment of the hinge 1 of FIG. 22 with the shutter A open at 90°.
Figure 25B:
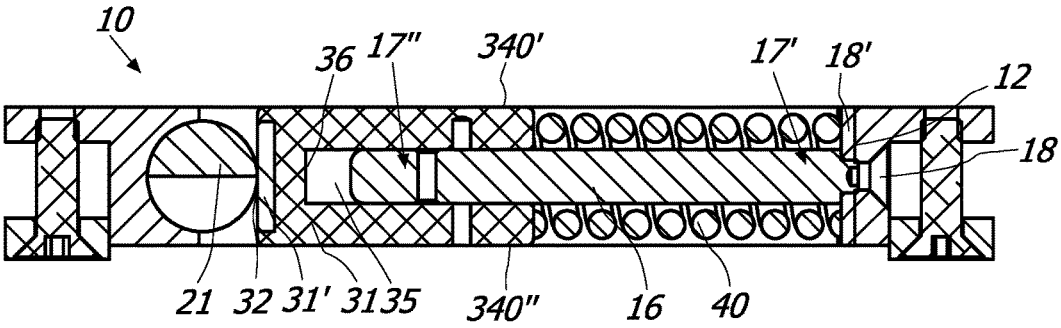
Figure 25C:
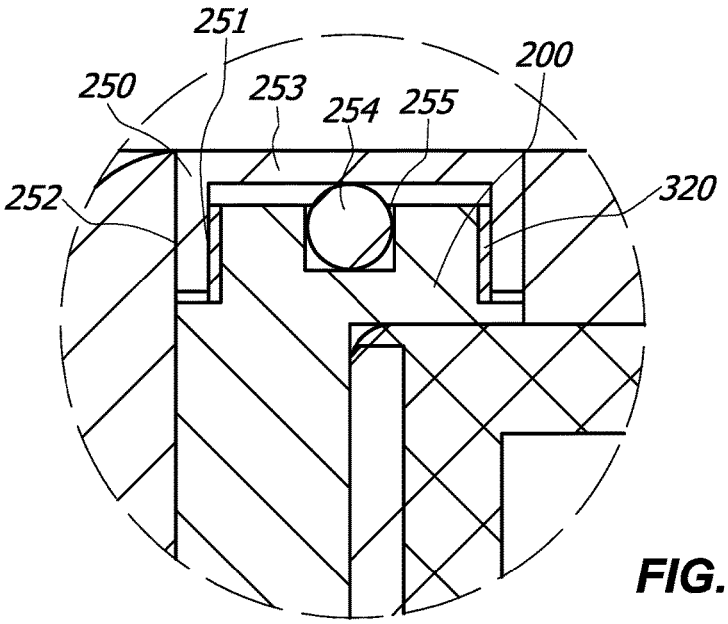
FIG. 25*c* is a section view of some details of a further embodiment of the hinge 1.
Figure 26:
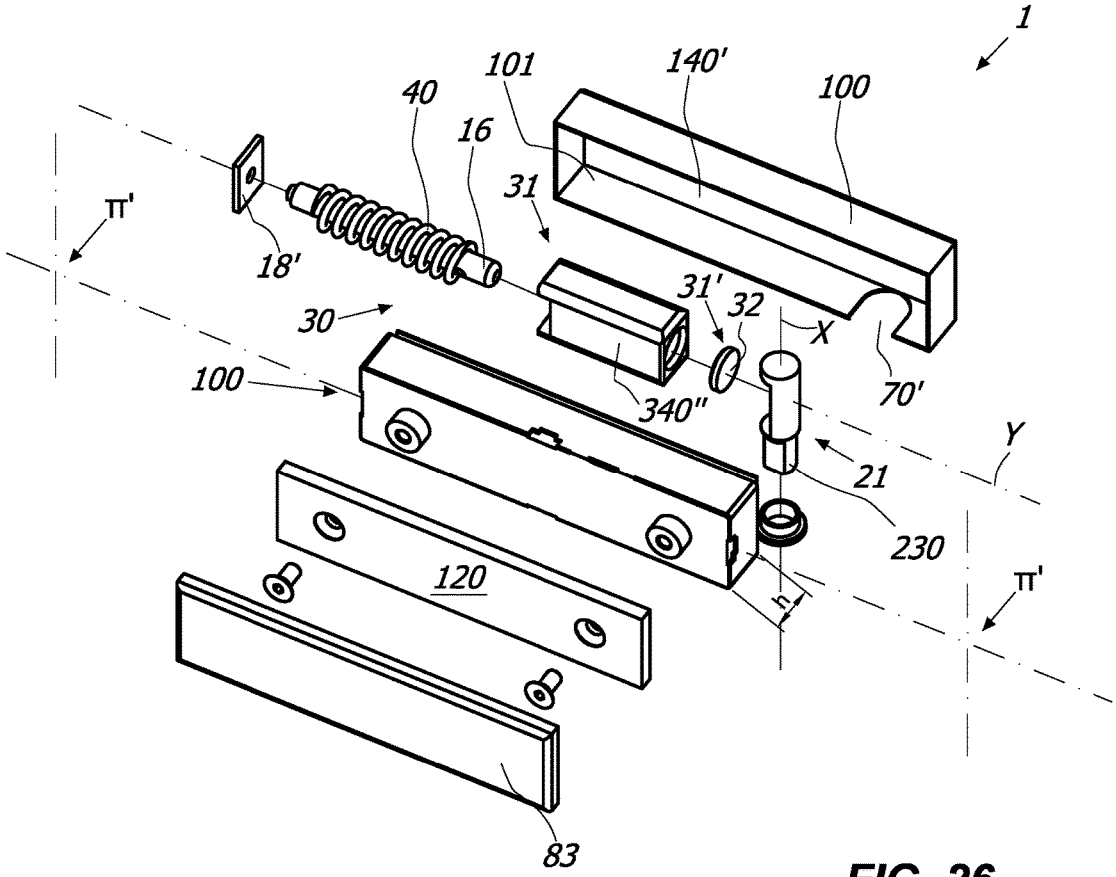
FIG. 26 is an exploded axonometric view of a further embodiment of the hinge 1.
Figure 27A:
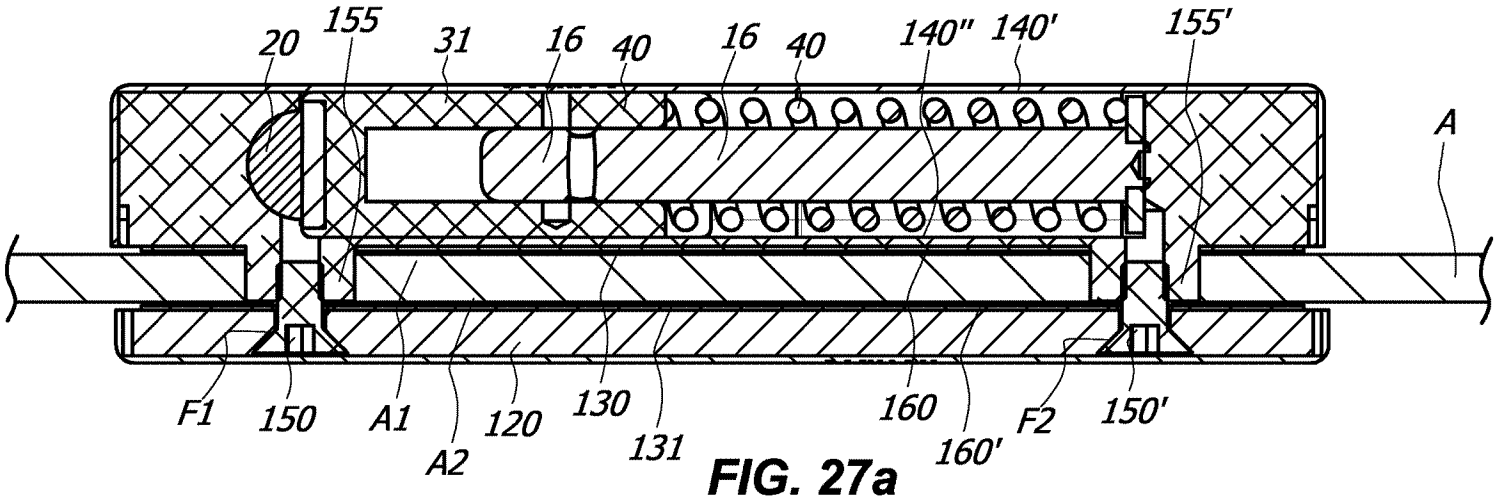
FIGS. 27*a* and 27*b* are section axial views with respect to the pivot 20 of the embodiment of the hinge 1 of FIG. 26 respectively with the shutter A closed and open at 90°.
Figure 27B:
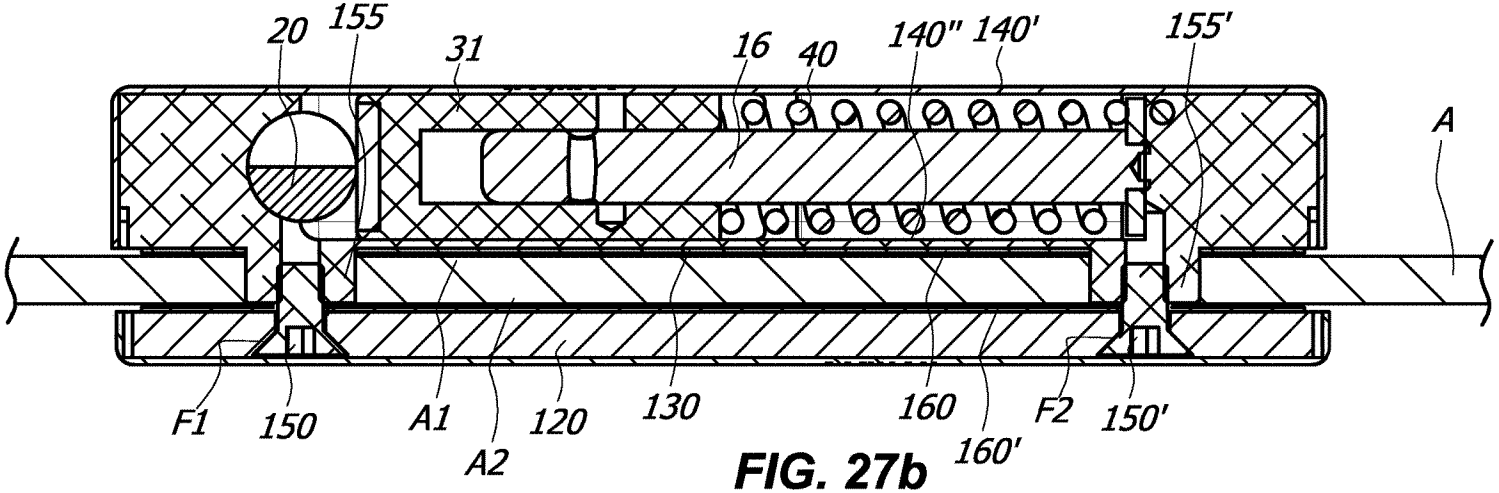
Figure 29A:
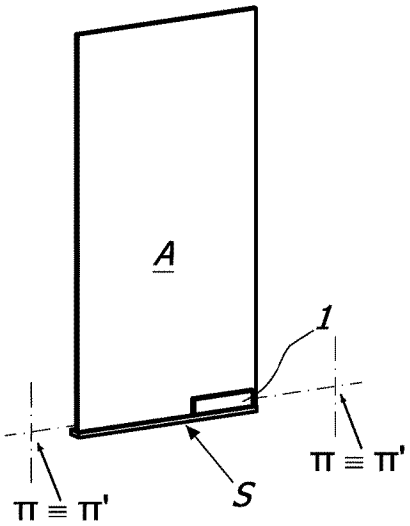
FIGS. 28, 29*a* and 29*b* are schematic views of the embodiment of the hinge 1 of FIG. 26 mounted on a shutter A.
Figure 29B:
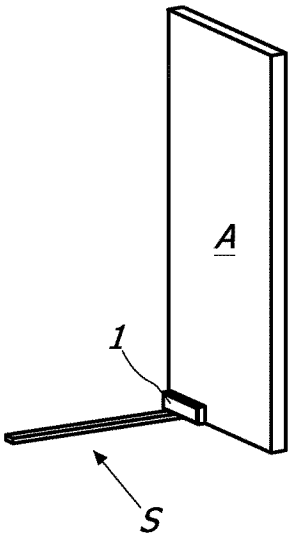
Figure 28:
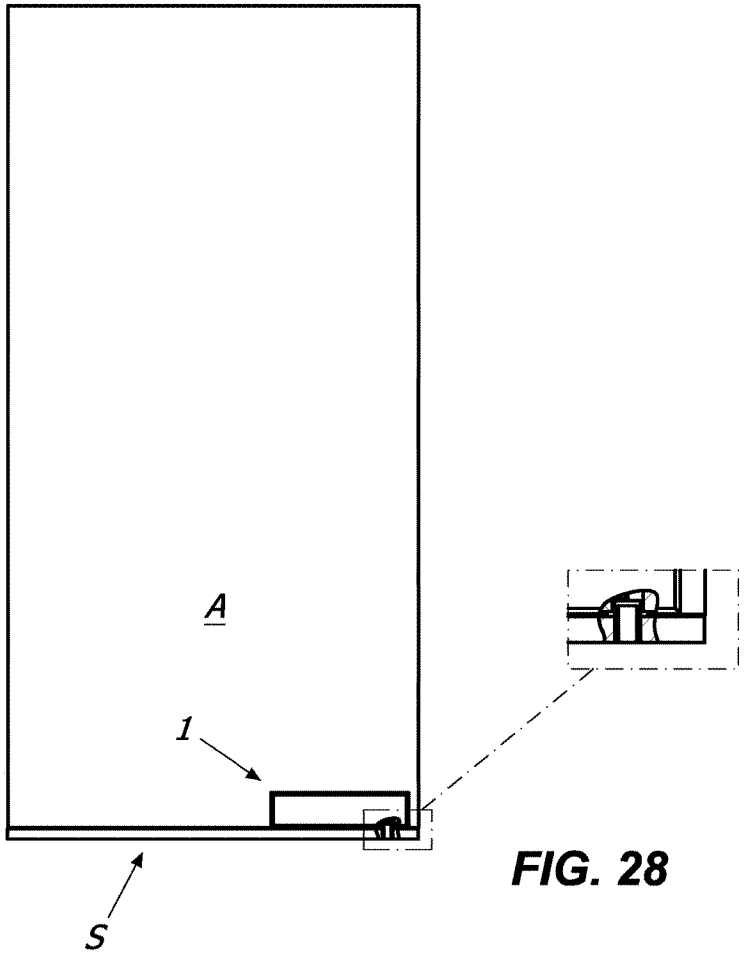

More particularly, as shown in FIG. 25*c*, at least one of the annular elements, for example the annular element 250, may include one or more anti-friction elements 320 interposed between the inner surface 251 thereof and the respective anchoring area 200 of the pivot 20 and in contact therewith.

In a preferred but not exclusive embodiment, shown for example in FIGS. 22 to 25*c*, the hinge body 10 may include a pair of pins 300, 310 inserted into respective seats 10''', 10'''' transverse to the plane π' of the hinge body 10 thereof to engage in an annular peripheral groove 215 of the anchoring area 210 of the pivot 20.

In this way, the annular element 250 and the pins 300, 310 cooperate with each other to axially and/or radially block the pivot 20 by counteracting the thrust of the coil spring 40 and/or avoiding the misalignment thereof.

The hinge 1 may be fully assembled without screws. This further simplifies the mounting, in addition to contain costs and bulkiness.

To the object, the hinge body 10 with all the components inserted in the working chamber 11 may be coupled to a box-shaped shell 100 so as the inner surface 101 of the latter remains in contact with the outer surface 10' of the hinge body 10.

The box-shaped shell 100 may cooperate with the inner surface 10" of the hinge body 10 to define the working chamber 11.

In particular, the hinge body 10 may comprise the first pair of shaped facing walls 14', 14", while the shell 100 may comprise both shaped facing walls 140', 140", or only one thereof.

Advantageously, to contain the costs of the hinge 1, the hinge body 10 may be made of polymeric material, while the shell 100 may be made of metallic material.

In a preferred but not exclusive embodiment, shown for example in FIGS. 26-29*b*, the shell 100 may be opened laterally to allow the lateral insertion of the hinge body 10. In this case, the wall 140' belongs to the shell 100, while the wall 140" belongs to the hinge body 10.

In another embodiment, shown for example in FIGS. 1 to 25*b*, the shell 100 may be an elongated box-shaped body wherein the hinge body 10 may be slidably insertable. In this case, both walls 140', 140" belong to the shell 100.

In any case, fastening means may be provided to reciprocally block in the operative position the hinge body 10 and the shell 100. For example, the latter may have a blocking tab 102 or some teeth that are snap-fitted in the hinge body 10.

Figure 30:
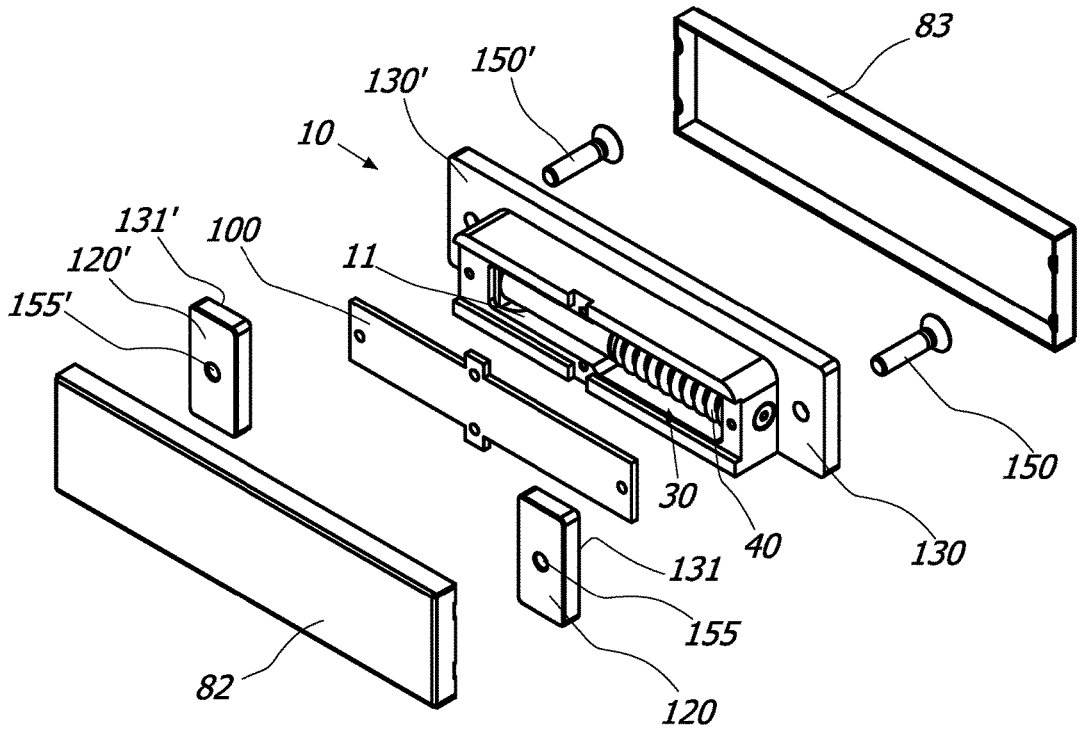
FIG. 30 is an exploded axonometric view of a further embodiment of the hinge 1.

FIG. 30 shows another embodiment of the closing element 100, alternative to the box-shaped shell. In this embodiment, the closing element 100 may be a plate coupled to the hinge body.

Figure 14:
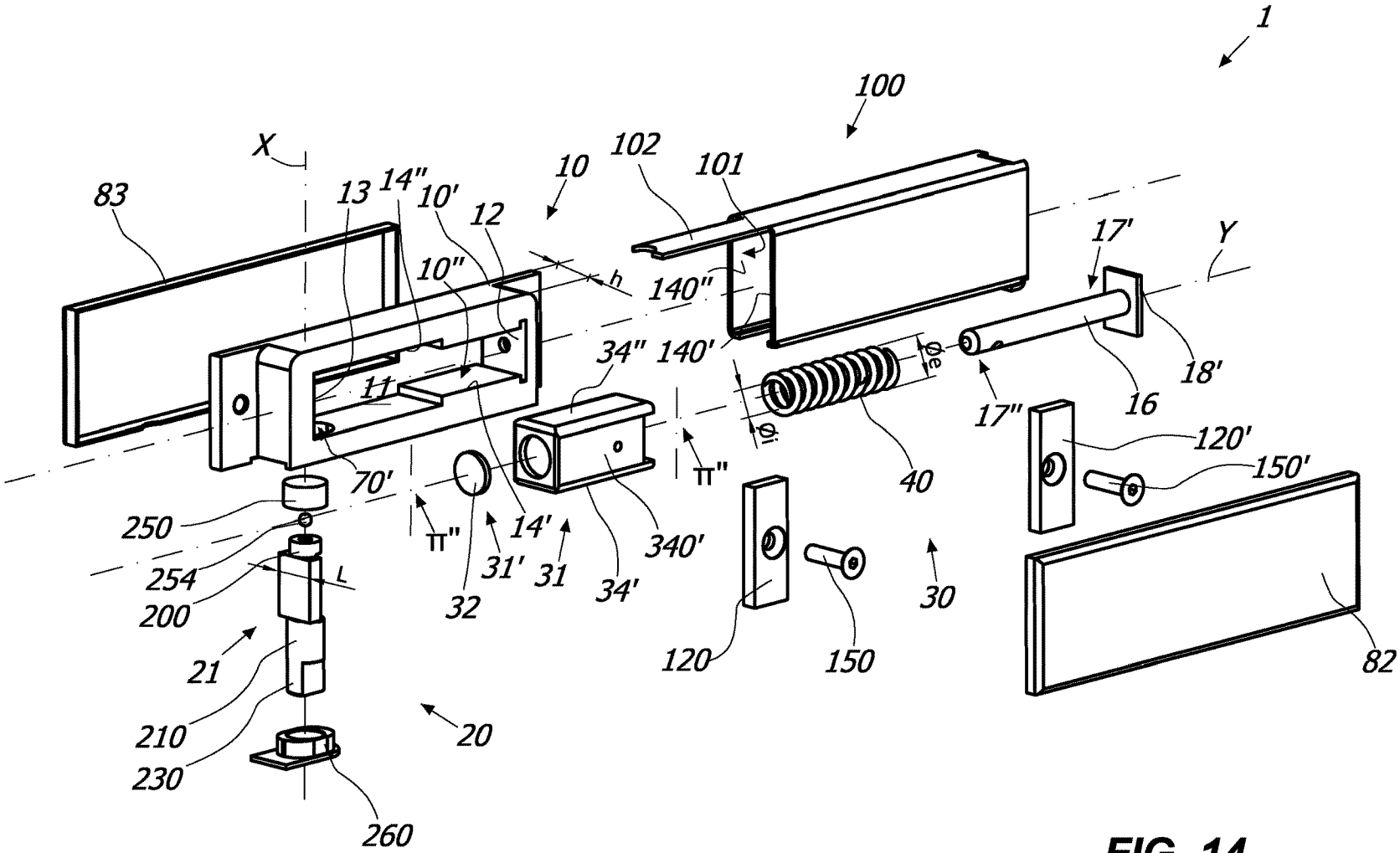
FIG. 14 is an exploded axonometric view of another embodiment of the hinge 1.
Figure 15A:
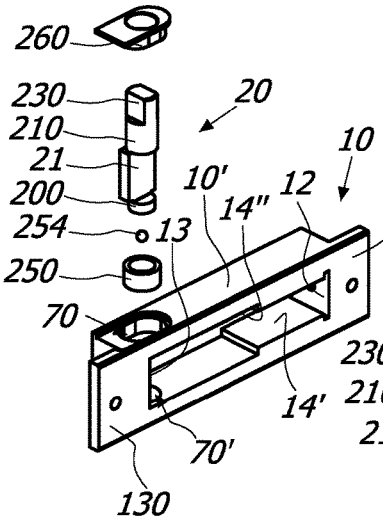
FIGS. 15*a* to 15*d* are axonometric views of some steps of the mounting of the pivot 20 in the hinge body 10 of the embodiment of the hinge 1 of FIG. 14.
Figure 15B:
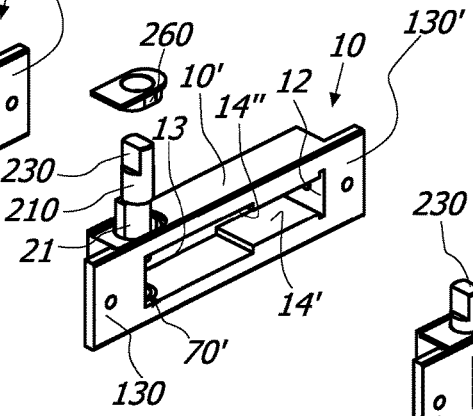
Figure 15D:
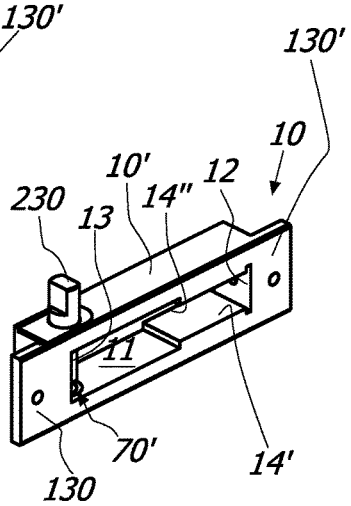
Figure 15C:
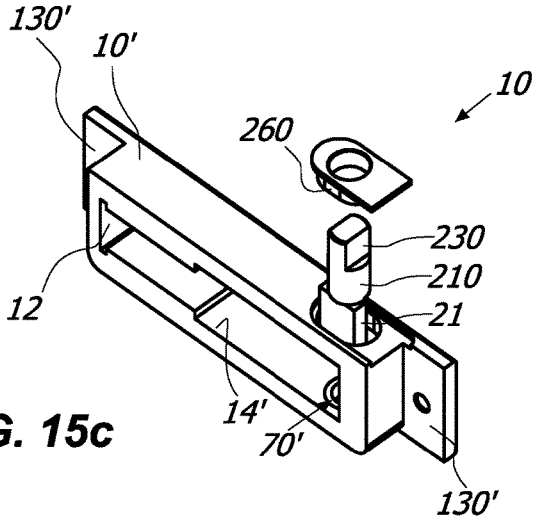
Figure 16A:
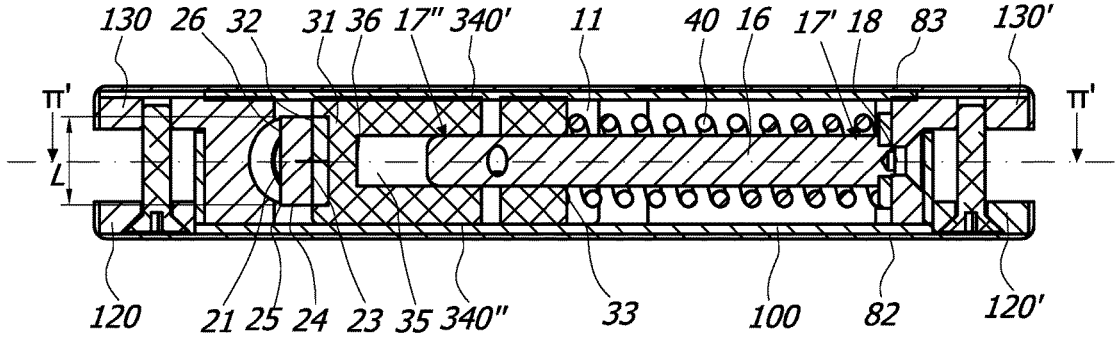
FIGS. 16*a* and 16*b* are section axial and radial views with respect to the pivot 20 of the embodiment of the hinge 1 of FIG. 14 with the shutter A closed.
Figure 16B:
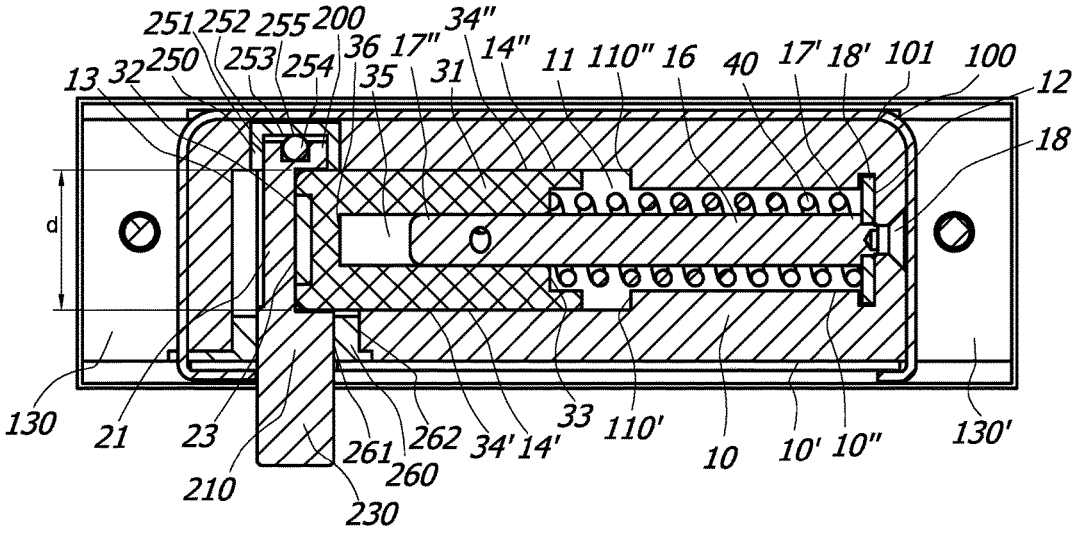
Figure 17A:
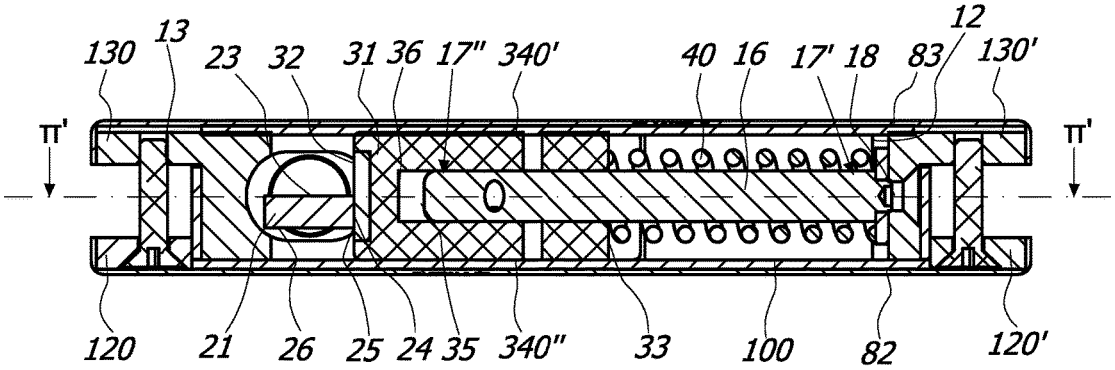
FIGS. 17*a* and 17*b* are section axial and radial views with respect to the pivot 20 of the embodiment of the hinge 1 of FIG. 14 with the shutter A open at 90°.
Figure 17B:
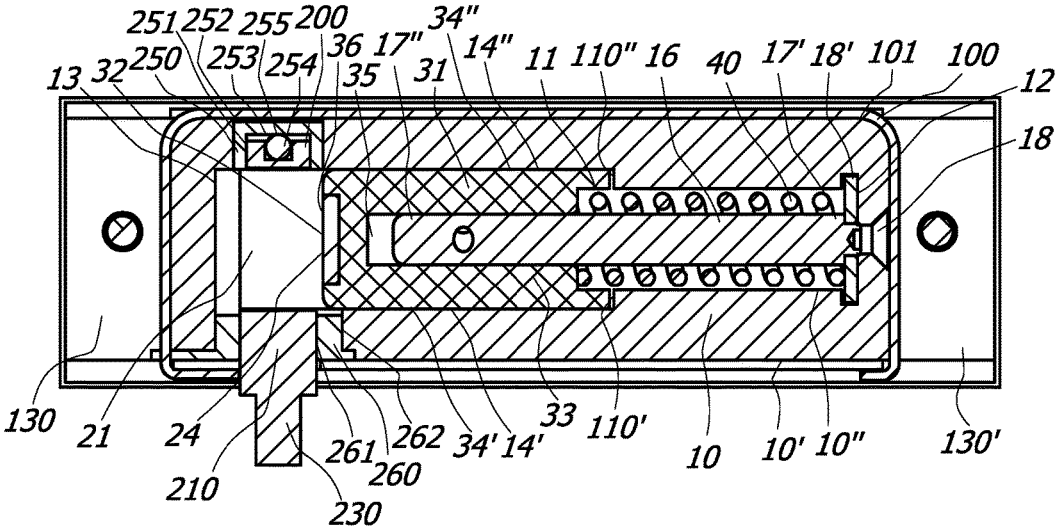
Figure 18A:
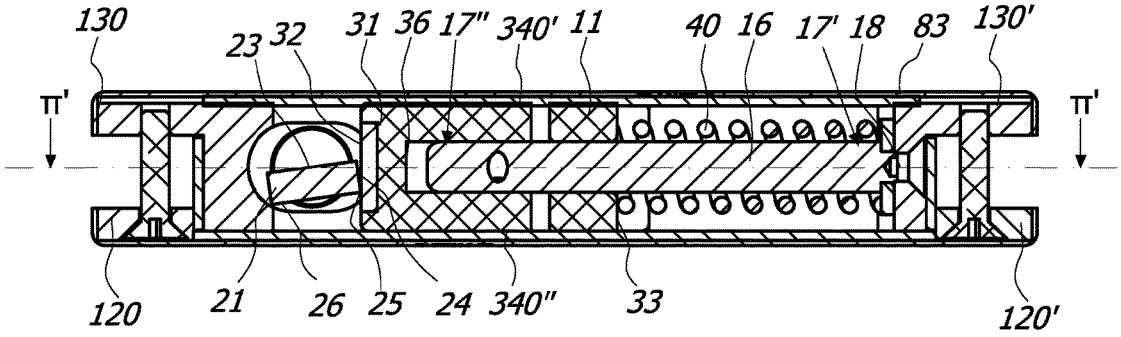
FIGS. 18*a* and 18*b* are section axial and radial views with respect to the pivot 20 of the embodiment of the hinge 1 of FIG. 14 with the shutter A open over 90°.
Figure 18B:
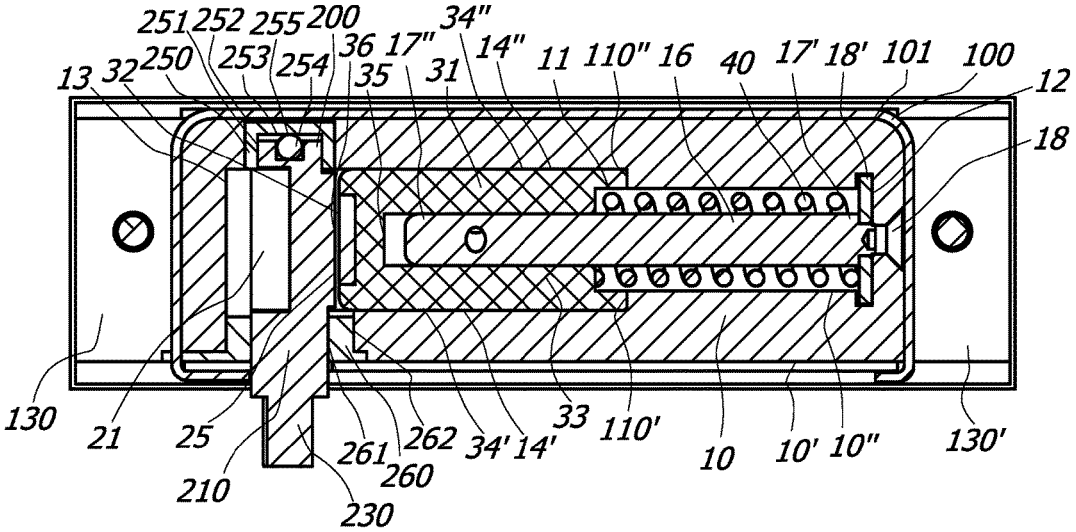
Figure 19:
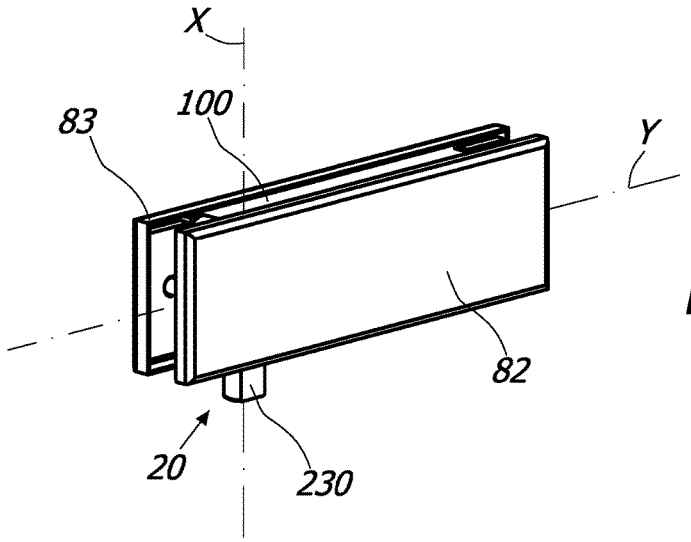
FIG. 19 is an axonometric view of the embodiment of the assembled hinge 1 of FIG. 14.
Figure 20:
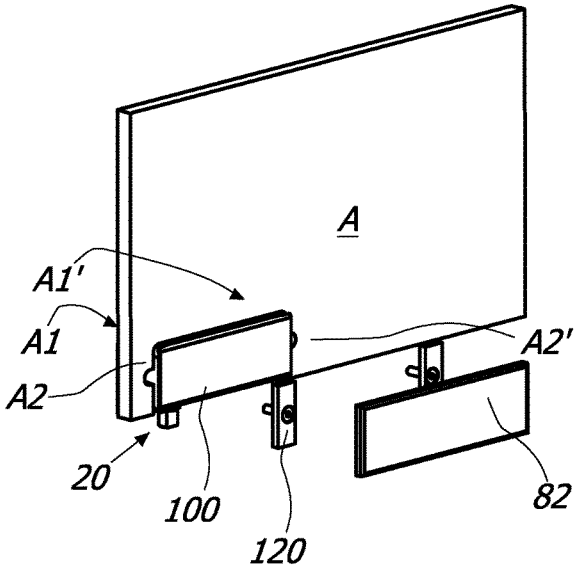
FIG. 20 is a schematic partially exploded view of the embodiment of the hinge 1 of FIG. 14 mounted on a shutter A.
Figure 21A:
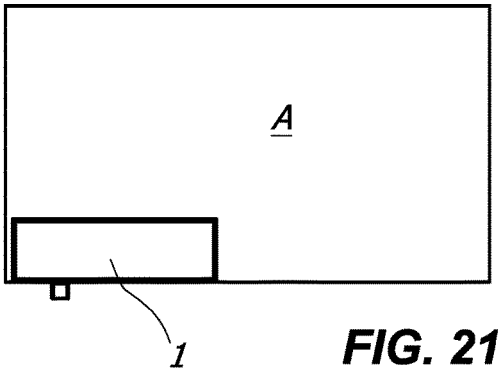
FIGS. 21*a* and 21*b* are respectively front and rear schematic views of the embodiment of the hinge 1 of FIG. 14 mounted on the shutter A.
Figure 21B:
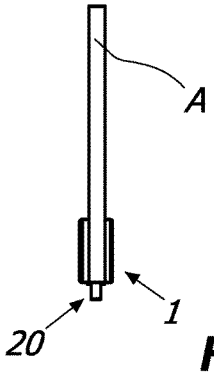
Figure 22:
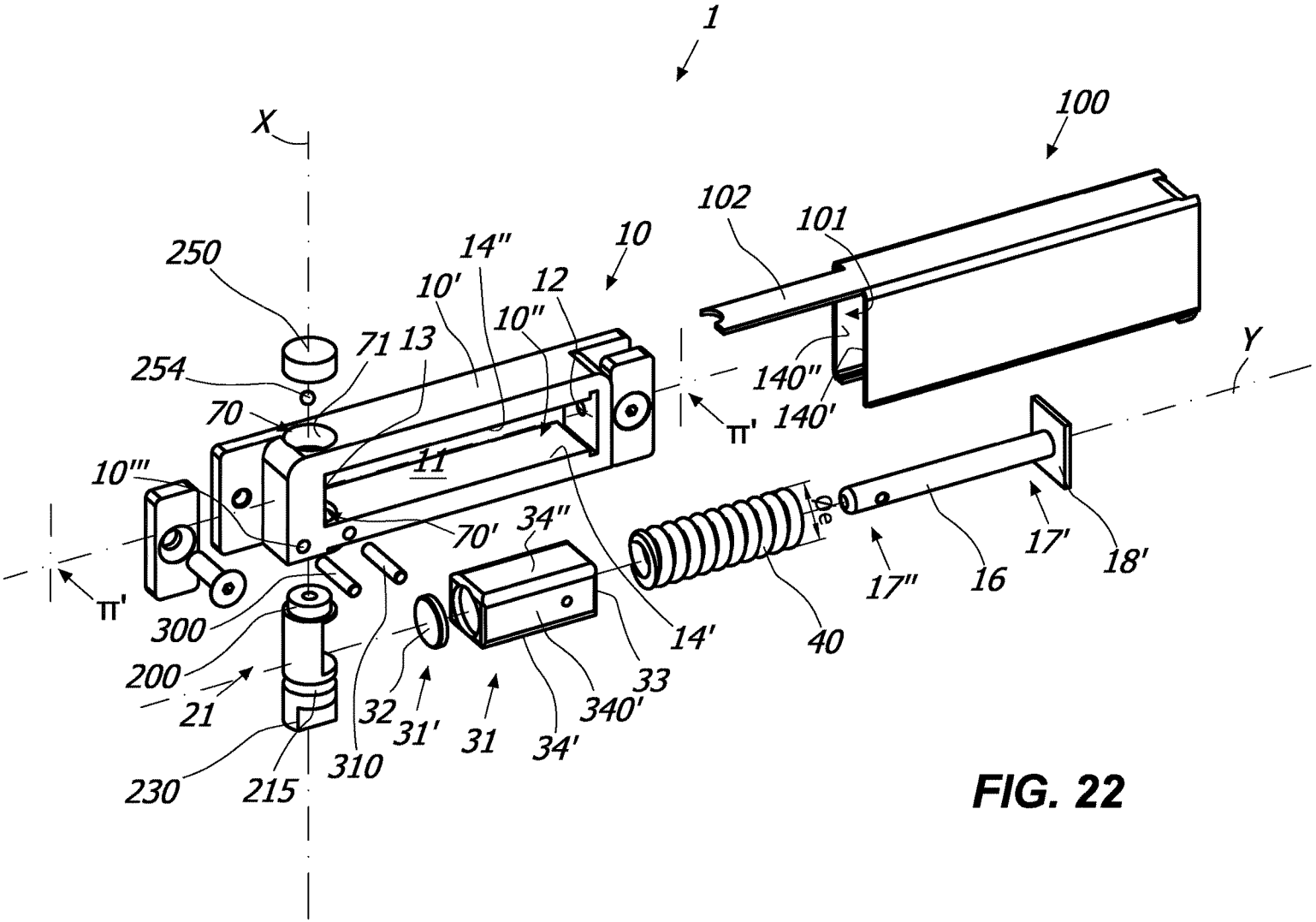
FIG. 22 is an exploded axonometric view of a further embodiment of the hinge 1.
Figure 23A:
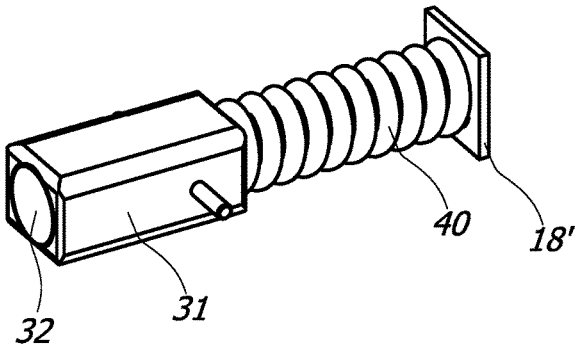
FIGS. 23*a* to 23*d* and 23*f* are axonometric views of some steps of the mounting of the assembly slider 31—rod 16—spring 40 in the working chamber 11 of the hinge body 10 of the embodiment of the hinge 1 of FIG. 22, with in FIGS. 23*e* and 23*g* respective section radial views with respect to the pivot 20 of FIGS. 23*d* and 23*f;*
Figure 23B:
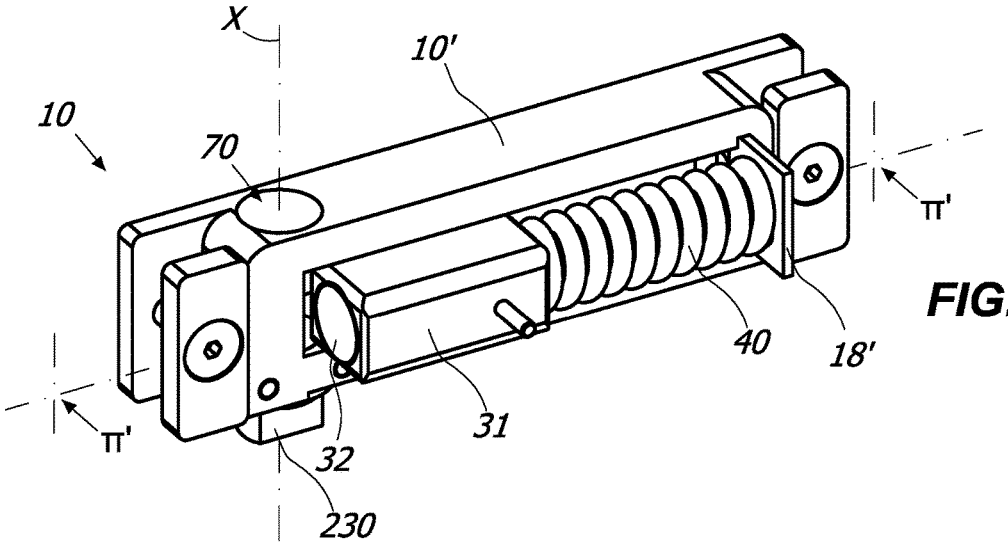
Figure 23C:
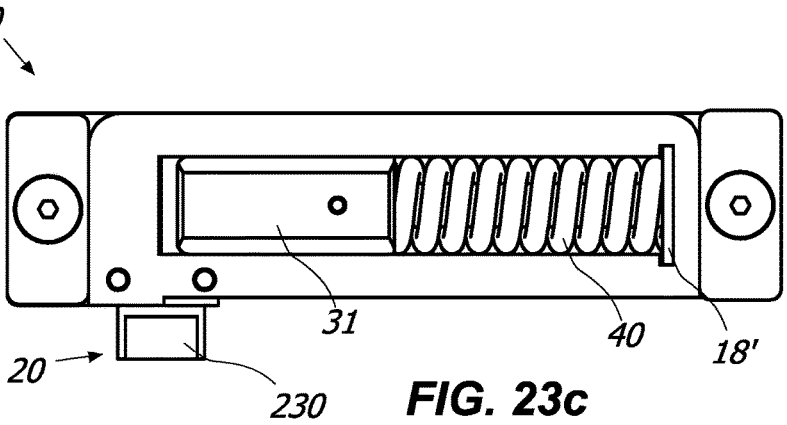
Figure 23D:
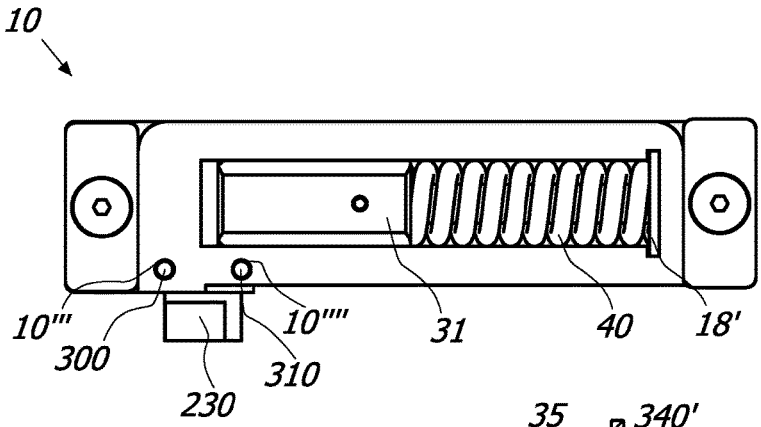
Figure 23E:
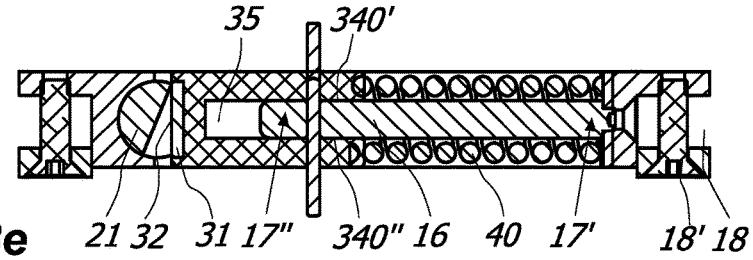
Figure 23F:
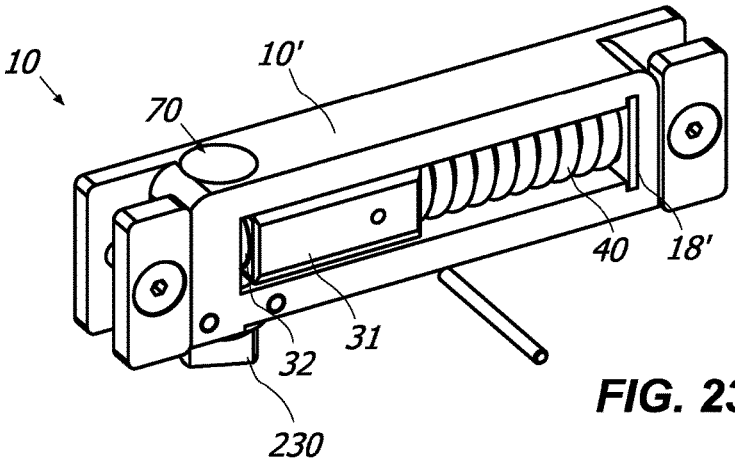
Figure 23G:
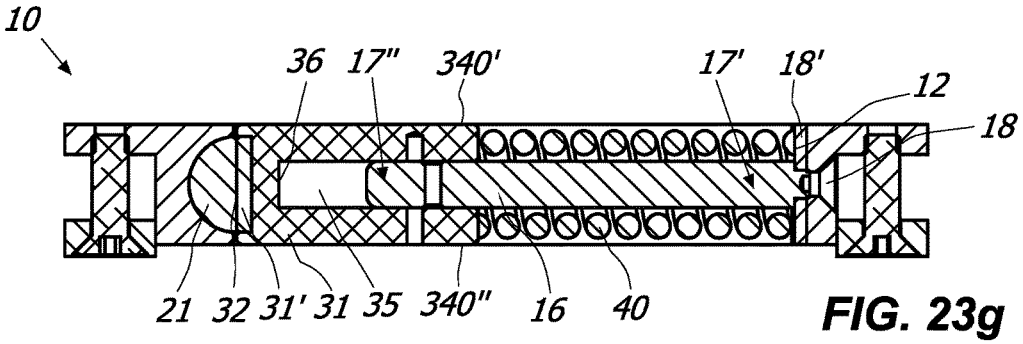
Figure 24A:
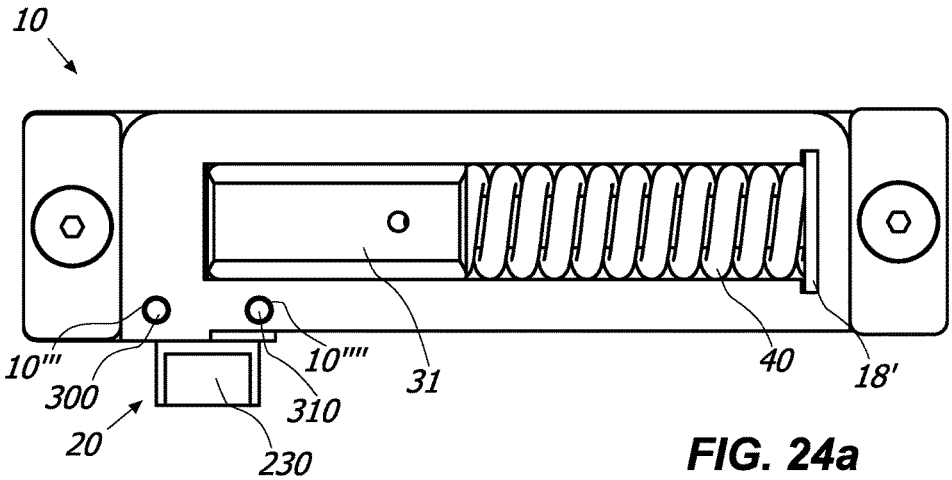
FIGS. 24*a*, 24*b* and 24*c* are respectively side and section axial and radial views with respect to the pivot 20 of the embodiment of the hinge 1 of FIG. 22 with the shutter A closed.
Figure 24B:
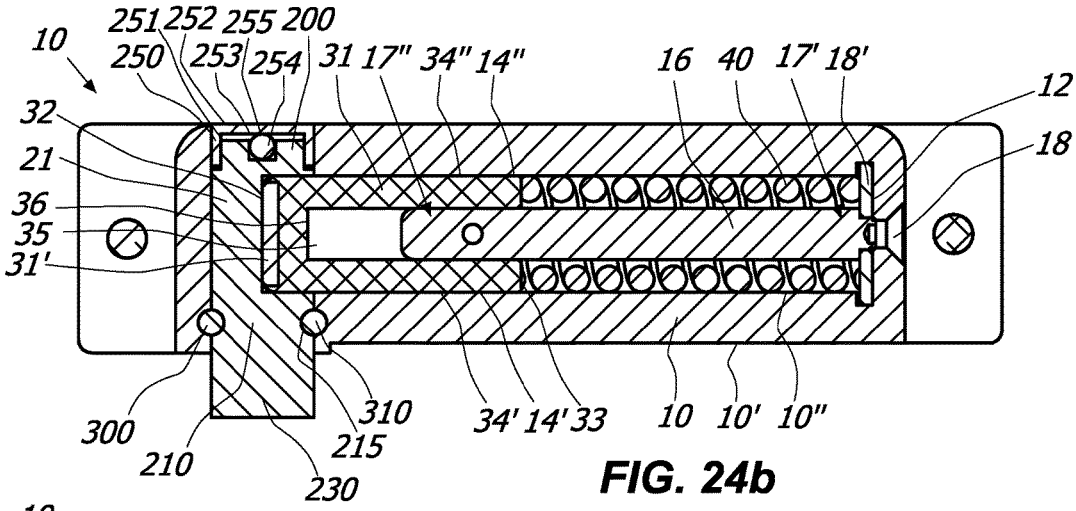
Figure 24C:
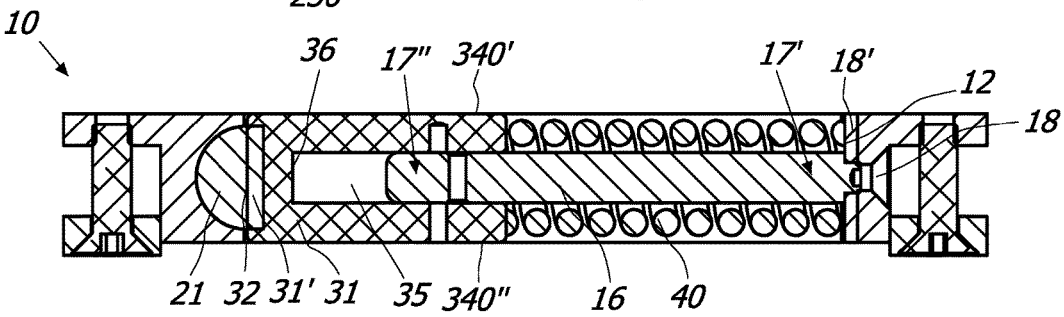

The hinge 1 may be of a mechanical type, as shown for example in FIG. 14, or it may include hydraulic damping means, as shown for example in FIG. 1, to hydraulically dampen the sliding along the axis Y.

In turn, the mechanical hinge 1 may include the rod 16, as shown for example in FIG. 1, or it may be devoid of it.

It is evident that the mechanical hinge is devoid of the hydraulic damping means, while the hydraulic hinge may include hydraulic damping means.

Suitably, such hydraulic damping means may be entirely contained within the slider 31, so as the coil spring 40 and the pivot 20 are not immersed in oil bath.

Suitably, the hydraulic damping means may include, respectively, they may consist of, a working fluid, for example oil, entirely contained in a hydraulic circuit 50 inside the slider 31. To the object, the hydraulic circuit 50 may include the blind hole 35.

This maximally simplifies the hinge structure 1, while minimizing the costs thereof. In fact, all the hydraulics of the hinge is entirely contained in the slider 31, the remaining parts remaining dry and, therefore, being much simpler to realize and manage.

Suitably, the second end 17" of the rod 16 may divide the blind hole 35 in a first and a second variable volume compartment 51', 51" fluidly communicating and adjacent therebetween.

To the object, the second end 17" of the rod 16 may include a cylindrical separation element 60 of the variable volume compartments 51', 51".

In a preferred but not exclusive embodiment, shown for example in FIG. 1, the cylindrical separation element 60 may be a cylinder open to be coupled to the second end 17" of the rod 16.

The separation element 60 may include an inner chamber 65 with a bottom wall 19', a side wall 63 and a front wall 61.

The latter may have a front surface 62' faced to the bottom wall 36 of the blind hole 35 and a rear surface 62" faced to the bottom wall 19' of an axial blind hole 19 made in correspondence of the second end 17" of the rod 16.

Suitably, the cylindrical separation element 60 may have the cylindrical wall 63 interposed between the side wall 19" of the second end 17" of the rod 16 and the side wall 37 of the blind hole 35 of the slider to act as a spacer therebetween.

Advantageously, the first compartment 51' may be defined by the bottom wall 36 of the axial blind hole 35, by the side wall 37 thereof and by the front surface 62' of the front wall 61, while the second compartment 51" may be defined by the axial blind hole 19 of the rod 16 and by the interspace between the cylindrical separation element 60 and an oil-seal 600 faced thereto and coupled to the slider 31 to close the axial blind hole 35. The first and the second compartment 51', 51" are fluidly communicating therebetween by means of the passage 59.

With regards to the second compartment 51", the axial blind hole 19 has constant volume, while the tubular interspace 52 varies in volume at the passage of the slider 31 from the distal position to the proximal one and vice versa.

Suitably, the compartments 51', 51" may be configured to have in correspondence of the closed shutter A position respectively the maximum and the minimum volume.

To allow the fluid communication between the two compartments 51', 51", controlling means of the flow of the working fluid may be provided to allow the passage thereof from the first compartment 51' to the second compartment 51" upon one of the opening or the closing of the shutter A and to allow the passage from the second compartment 51" to the first compartment 51' upon the other of the opening or the closing of the shutter A.

In a preferred but not exclusive embodiment, the controlling means of the flow of the working fluid may comprise an opening 53 passing through the separation element 60 in correspondence of the wall 61 and valve means to allow the controlled passage of the working fluid between the two compartments 51', 51".

Suitably, the valve means may comprise a plug element 64 movable in a seat 65 defined by the inner chamber of the cylindrical separation element 60. The valve seat 65 may be interposed between the passing-through opening 53 and the blind hole 19 of the end 17" of the rod 16 and it allows the plug 64 to move between a first working position, shown for example in FIG. 6*b*, wherein the plug element 64 is in contact with the passing-through opening 53 and a second working position, shown for example in FIG. 6*a*, wherein the plug element 64 thereof is spaced thereto.

Depending on the configuration of plug 64, when the same plug is in the first working position the two compartments 51', 51" are or are not in fluid communication by means of the passing-through opening 53 of the cylindrical separation element 60.

In a first embodiment, the plug element 64 may include a calibrated opening 54, preferably in a central position, to allow the passage of the working fluid between the two compartments 51', 51" by means of the passing-through opening 53 when the plug element 64 thereof is in the first working position.

The calibrated opening 54 may have a diameter lower than 1 mm, and preferably lower than 0.5 mm. Indicatively, such a calibrated opening 54 may have a diameter of 1-3 tenths of millimeter.

Therefore, when the plug element 64 is in the first working position, corresponding to the distal position of the slider 31, the working fluid exclusively passes through the calibrated opening 54, while when the plug element 64 thereof is in the second working position, corresponding to the proximal position of the slider 31, the working fluid passes both through the calibrated opening 54 and through a plurality of peripheral passages 55 thereof. Therefore, in such an embodiment, the hydraulic circuit 50 may be entirely contained inside the blind hole 35 of the slider 31.

In a preferred but not exclusive embodiment, shown for example in FIGS. 11*a* and 11*b*, the valve seat 65 may include a pin 650 passing through a hole 640 of the plug element 64.

In this case, the calibrated opening 54 may be defined by the interspace between the hole 640 of the plug element 64 and the passing-through pin 650.

In any case, the calibrated opening 54 may have a passage section lower than 2 $mm^2$, preferably lower than 1 $mm^2$, even more preferably lower than 0.5 $mm^2$ and ideally lower than 0.35 $mm^2$.

Advantageously, the pin 650 may be inserted through a hole 610 of the front wall 61 of the chamber 65.

In this case, the passing-through opening 53 may be defined by the interspace between the hole 610 of the front wall 61 of the chamber 65 and the passing-through pin 650.

Suitably, the pin 650 may be inserted through the plug element 64 and the front wall 61 of the chamber 65 to freely move along the axis Y.

To the object, the bottom wall 19' of the chamber 65 may include a seat for the pin 650, the seat thereof may be defined by the axial blind hole 19.

Suitably, the pin 650 and the axial blind hole 19 may be reciprocally dimensioned so as in the distal position of the slider 31 the pin 650 is within the seat 19 thereof upon the interaction with the bottom wall 36 of the blind hole 35, and in the proximal position of the slider 31 thereof, the pin 650 telescopically exits from the seat 19 thereof, remaining partially inserted therein, so as not to slip off.

Thanks to the above mentioned features, the free sliding of the pin 650 during the sliding of the slider 31 maintains the passing-through opening 53 and the calibrated opening 54, that are very low-bulky, free from any dirt and/or foreign bodies.

Suitably, slip-preventing means may be provided to prevent the slippage of the pin 650 from the seat 651 during the sliding. For example, the seat 651 may have ends that may be chamfered, that may act as abutments for the pin 650.

Figure 6A:
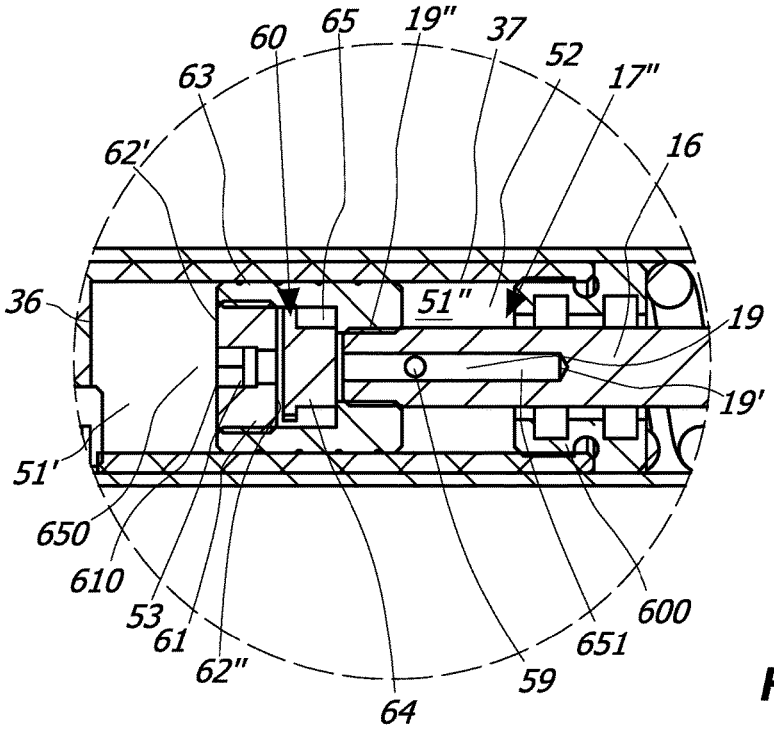
FIGS. 6*a* and 6*b* are enlarged views of some details of the first embodiment of the hinge 1 of FIG. 1 with the shutter A closed and open.
Figure 6B:
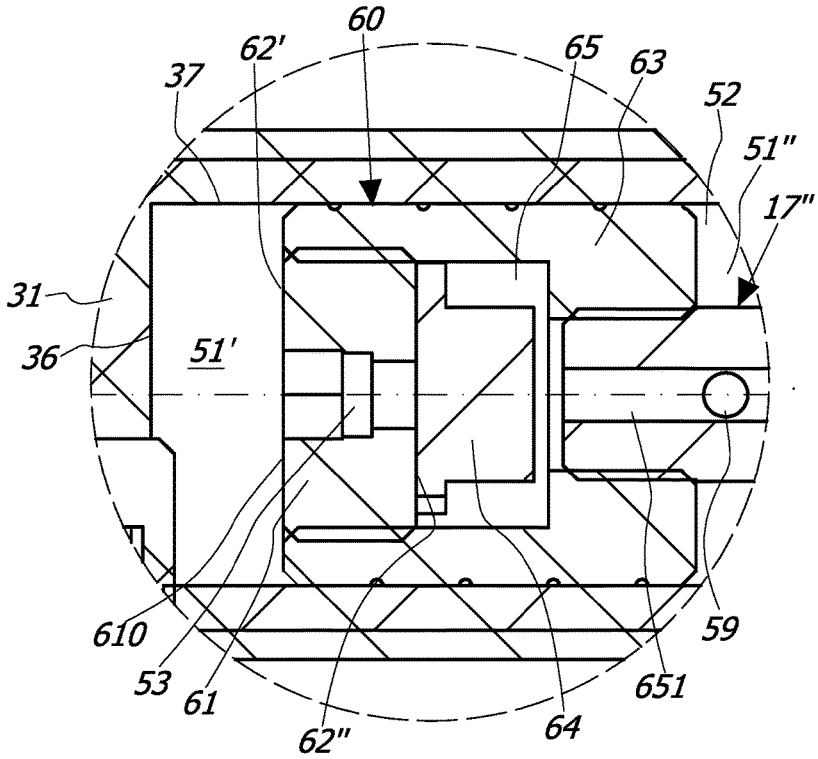

In a second embodiment, shown for example in FIGS. 6*a* and 6*b*, the plug element 64 is devoid of the calibrated central hole 54. Therefore, when the plug element 64 is in the first working position the working fluid may not pass through the passing-through opening 53 of the cylindrical separation element 60.

To allow the fluid communication between the compartments 51', 51" when the plug element 64 is in the first working position, a channel 60' may be provided encompassing the separation element 60.

As stated above, the hinge 1 is particularly suitable for glass shutters A or shutters of cold rooms.

Figure 2A:
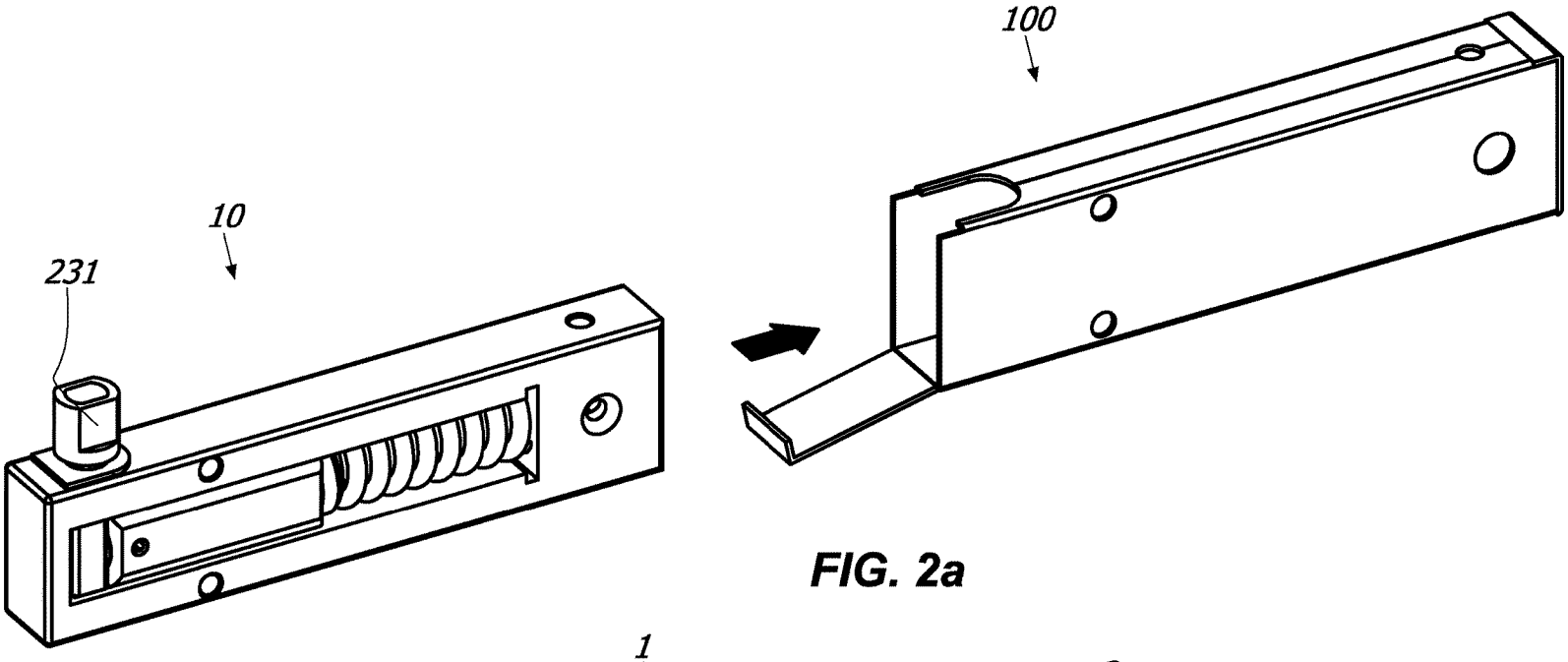
FIG. 2*a* is an axonometric view of the first embodiment of the hinge 1 of FIG. 1 before the insertion of the hinge body 10 in the shell 100.
Figure 2B:
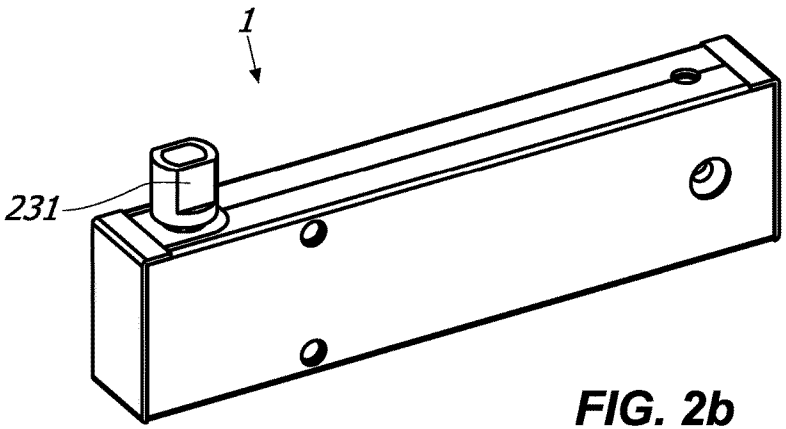
FIG. 2*b* is an axonometric view of the first embodiment of the assembled hinge 1 of FIG. 1.
Figure 3A:
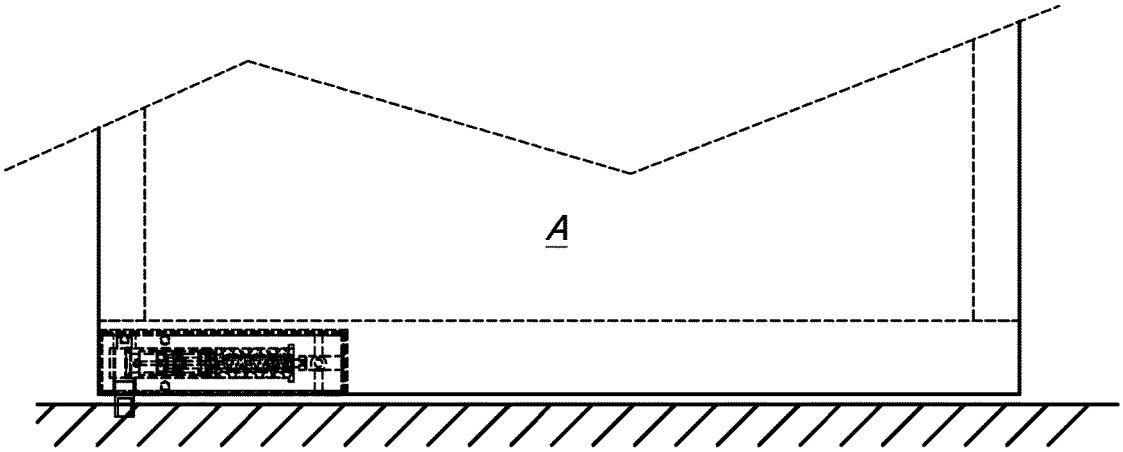
FIGS. 3*a* and 3*b* are respectively side and bottom axonometric views of the first embodiment of the hinge 1 of FIG. 1 inserted in a concealed way in a tubular frame S wherefrom the driving fitting 231 comes out.
Figure 3B:
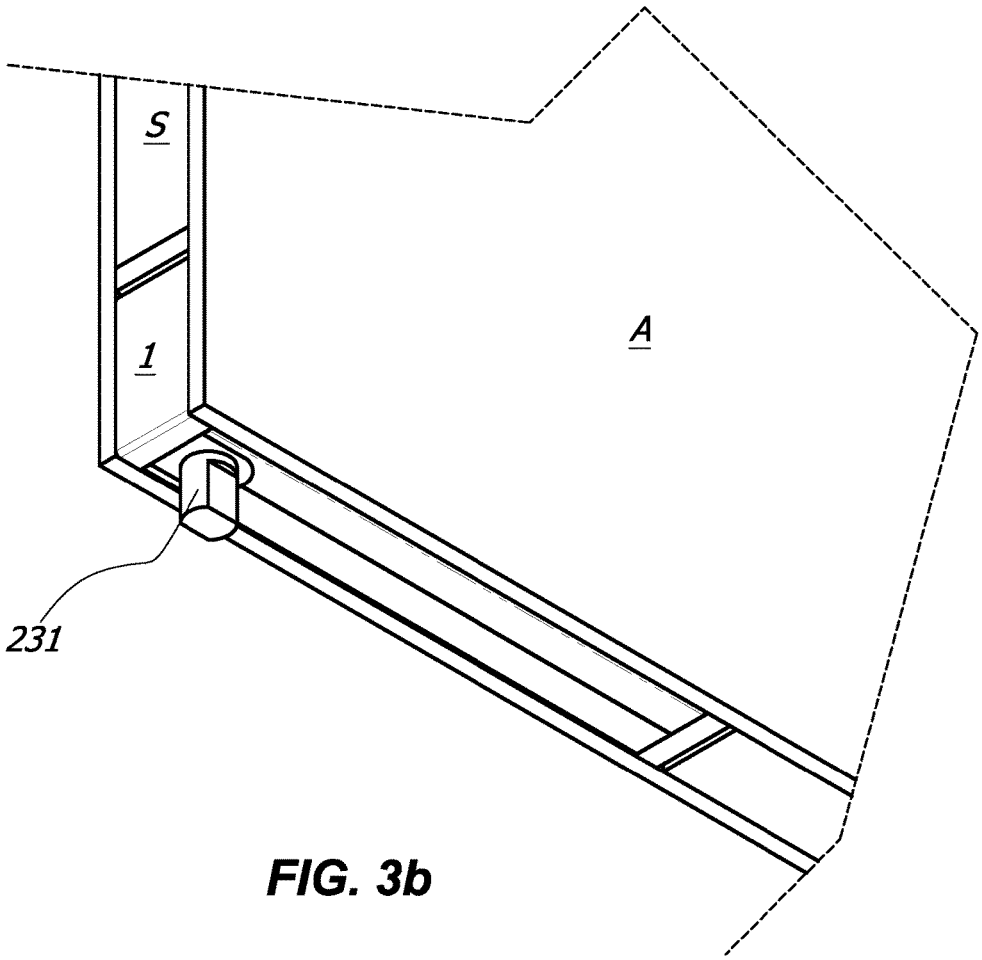
Figure 4A:
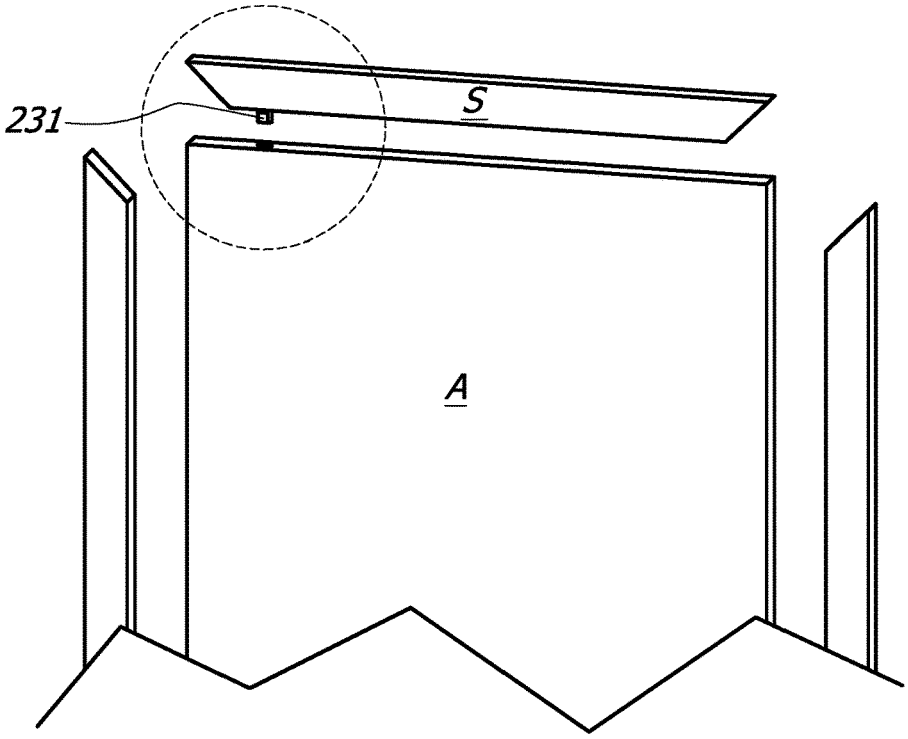
FIG. 4*a* is a further axonometric view of the first embodiment of the hinge 1 of FIG. 1 inserted in a concealed way in a tubular frame S wherefrom the driving fitting 231 comes out, with some enlarged details in FIG. 4*b;*
Figure 4B:
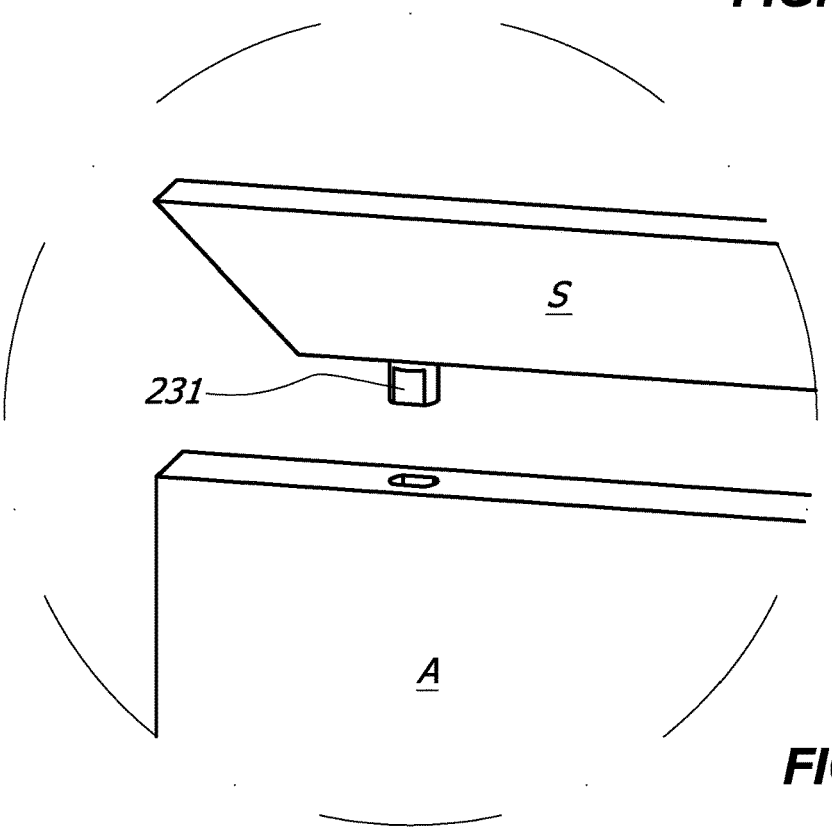

In particular, in the embodiments of FIGS. 1 to 21*b* the hinge 1 once assembled as shown for example in FIG. 2*b* has a parallelepiped shape suitable to be inserted in the tubular frame of the shutter A, as shown for example in FIGS. 4*a* and 4*b*.

Moreover, the low-bulkiness of the hinge 1 further makes it suitable to be inserted between the two glass plates of a double-glazing glass, as for example shown in FIGS. 3*a* and 3*b*.

On the other hand, the hinge 1 may cooperate with one or more fastening plate-shaped elements 120 to fasten from opposite sides a glass shutter A so as the latter remains interposed therebetween.

More particularly, in the embodiment shown in FIGS. 26 to 29*b* the hinge 1 may include a portion 130 suitable to interact with a corresponding first portion A1 of the glass shutter A, while the fastening element 120 may comprise a portion 131 faced to the portion 130 suitable to interact with a corresponding second portion A2 of the glass shutter A opposite to the first portion A1. Suitably, the glass shutter A may be protected by suitable seals 160, 160'.

In the embodiments shown in FIGS. 14 to 25*b*, the hinge 1 may include portions 130, 130' extending from opposite sides of the hinge body 10 to interact with a corresponding pair of first portions A1, A1' of the glass shutter A, while the fastening elements 120, 120' may have respective second portions 131, 131' suitable to interact with a corresponding pair of second portions A2, A2' of the glass shutter A opposite to the first portions A1, A1'.

Suitably, the first portions 130, 130' may extend from the hinge body 10 in correspondence of a side wall thereof, while the fastening elements 120, 120' may be dimensioned so as to remain flush with the opposite side wall of the hinge body 10, so that the glass shutter A is placed in a substantially central position with respect to the hinge body 10 thereof.

Advantageously, the box-shaped shell 100 may leave free the portions 130 or 130, 130' of the hinge body 10 for the fastening of the glass shutter A.

Figure 31A:
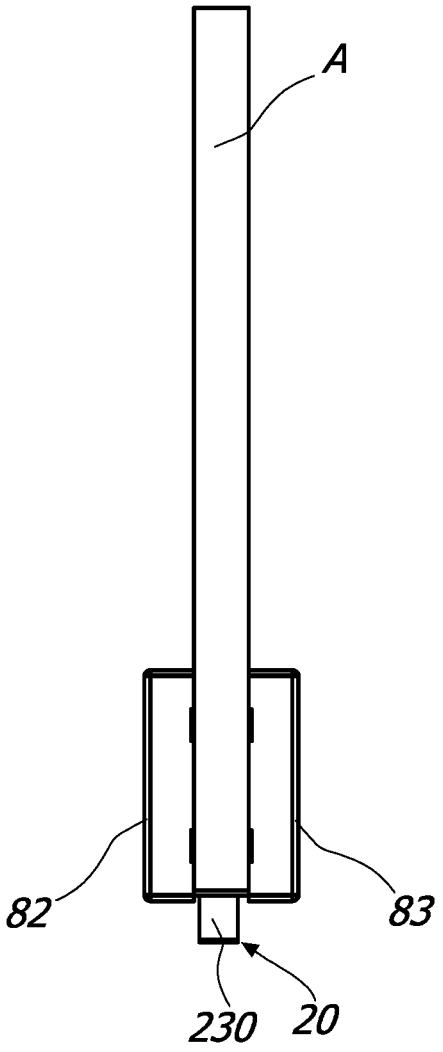
FIGS. 31*a* and 31*b* are schematic views of the application of the embodiment of the hinge 1 of FIG. 30 to shutters A with different thickness.
Figure 31B:
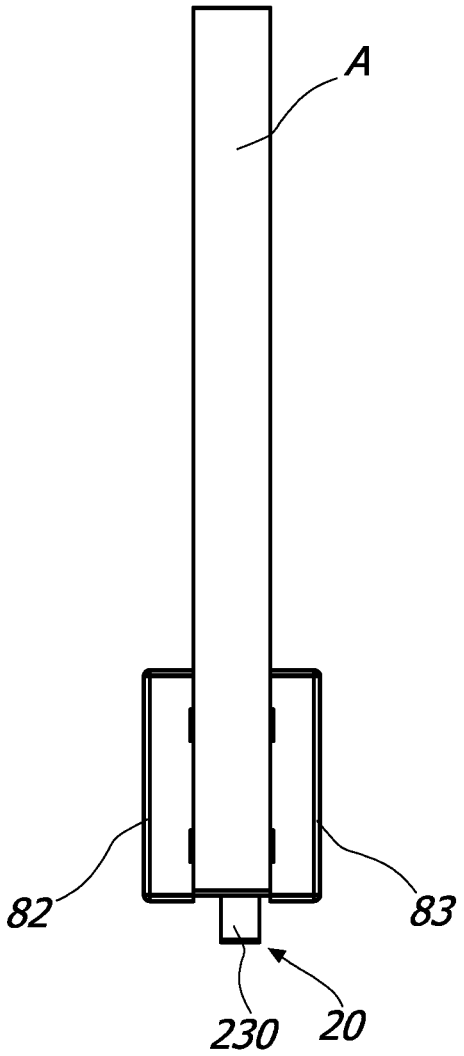
Figure 34:
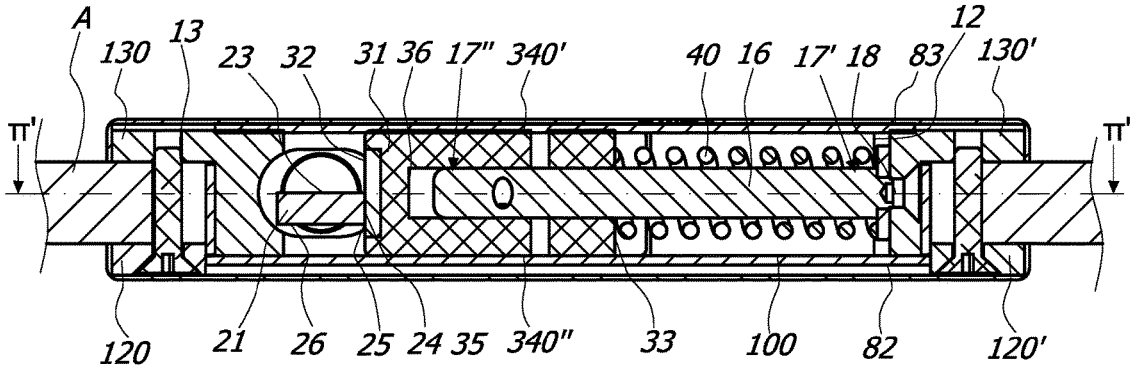
FIG. 34 is a section axial view of the embodiment of the hinge 1 of FIG. 17*a* applied to a glass with a relatively high thickness.

In a preferred but not exclusive embodiment, one of the covers 83 may be couplable to the hinge body 10, while the other of the covers 82 may be couplable to the fastening elements 120, 120'. In this way, as shown in FIGS. 31*a*, 31*b* and 34, the cover 82 may always remain in contact with the glass shutter A regardless of the thickness thereof.

For the reciprocal blocking of the hinge 1 and of the fastening plate-shaped elements 120 or 120, 120' that include a pair of screws 150, 150' insertable in a corresponding pair of seats 155, 155', the latter possibly passing through a corresponding pair of passing-through holes F1, F2 of the glass shutter A.

Thanks to the above mentioned features, the hinge 1 practically acts as "patch" for the glass shutter A, and, therefore, it has minimal visual impact thereon.

Figure 32:
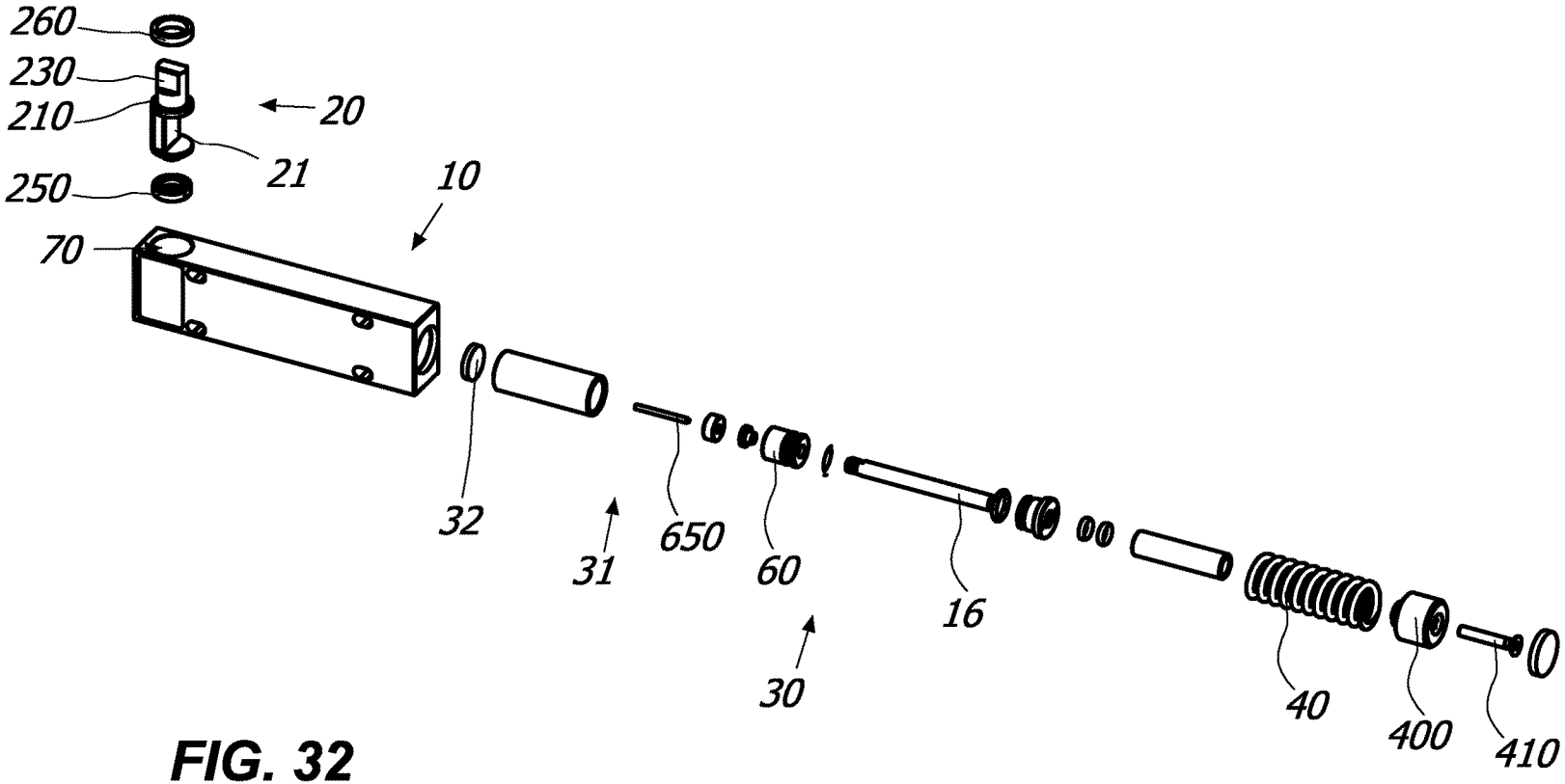
FIG. 32 is an exploded axonometric view of a further embodiment of the hinge 1.

In a further preferred but not exclusive embodiment, shown for example in FIGS. 32, 33*a* and 33*b*, the hinge 1 may include a pressing element 400 coupled to the rod 16 to adjust the pre-loading of the coil spring 40, preferably screwed on the rod 16 thereof.

To the object, the pressing element 400 may be coupled to the rod 16 by means of a sliding coupling element 410 having one operation end 411 controlled by a user and an opposite end 412 screwable on the rod 16.

The coupling element 410 may include a smooth portion 413 for the idle sliding of the pressing element 400 and a portion 414 susceptible to abut against the latter.

In this way, the screwing/unscrewing of the coupling element 410 with respect to the rod 16 may determine the greater or lower pre-loading of the coil spring 40.

From the above description, it appears evident that the hinge according to the invention fulfils the intended objects.

The hinge according to the invention is susceptible of numerous modifications and variations, all falling within the inventive concept expressed in the appended claims. All the details may be replaced with other technically equivalent elements, and the materials may be different according to requirements, without departing from the scope of the invention.

Although the hinge has been described with particular reference to the annexed figures, the reference numbers used in the description and in the claims are used to improve the intelligence of the invention and do not constitute any limitation to the scope of protection claimed.

The invention claimed is:

1. A low-bulkiness hinge for a door anchored to a stationary support structure, one of the door or the stationary support structure defining a first plane, the low-bulkiness hinge comprising:

a plate-shaped hinge body defining a second plane, the hinge body being anchorable to the one of the door or the stationary support structure so that the first plane and the second plane are coincident or parallel to each other, the hinge body including an inner surface; and a pivot defining a first longitudinal axis parallel to the second plane or lying thereon, the pivot being anchorable to the other one of the door or the stationary support structure, the pivot and the hinge body being reciprocally coupled so as to rotate around the first axis between an opening position and a closing position, wherein the hinge body includes a lateral opening and a closing element for closing the lateral opening, the inner surface of the hinge body and the closing element reciprocally cooperating to define a working chamber extending along a second longitudinal axis perpendicular to the first axis, wherein the working chamber includes a slider sliding along the second axis, a first pair of guiding facing walls and a second pair of guiding facing walls interacting or being in reciprocal contact with the slider, the hinge body comprising the first pair of guiding facing walls, the closing element comprising at least one of the guiding facing walls of the second pair, and wherein the pivot further includes a cam element integrally rotatable therewith, the slider comprising an operative face interacting with the cam element.

2. The low-bulkiness hinge according to claim 1, wherein the guiding walls of the first pair are substantially transversal with respect to the guiding walls of the second pair.

3. The low-bulkiness hinge according to claim 1, wherein the closing element includes one of the guiding walls of the second pair, the hinge body including the other guiding walls of the second pair.

4. The low-bulkiness hinge according to claim 1, wherein the closing element has walls with a thickness lower than a thickness of the hinge body.

5. The low-bulkiness hinge according to claim 4, wherein a ratio between the thickness of the closing element walls and the thickness of the hinge body is greater than 1:5.

6. The low-bulkiness hinge according to claim 4, wherein a ratio between the thickness of the closing element walls and the thickness of the hinge body is greater than 1:10.

7. The low-bulkiness hinge according to claim 4, wherein a ratio between the thickness of the closing element walls and the thickness of the hinge body is greater than 1:15.

8. The low-bulkiness hinge according to claim 1, wherein the closing element is a plate coupled to the hinge body.

9. The low-bulkiness hinge according to claim 1, wherein the closing element is a box-shaped shell coupled to the hinge body.

10. The low-bulkiness hinge according to claim 9, wherein the box-shaped shell has an inner surface, an outer surface of the hinge body being in contact with the inner surface of the box-shaped shell.

11. The low-bulkiness hinge according to claim 9, wherein the box-shaped shell has an open side to allow a lateral insertion of the hinge body therein.

12. The low-bulkiness hinge according to claim 9, wherein the box-shaped shell is open in a front or rear side thereof to allow an axial insertion of the hinge body therein, the shell including both guiding facing walls of the second pair.

13. The low-bulkiness hinge according to claim 1, wherein one of the closing element or the hinge body includes a fastening member to fasten to the other one of the closing element or the hinge body.

14. The low-bulkiness hinge according to claim 1, wherein the hinge body is made of a polymeric material, the closing element being made of a metallic material.

15. A low-bulkiness hinge for closing a door anchored to a stationary support structure, one of the door or the stationary support structure defining a first plane, the low-bulkiness hinge comprising:

a plate-shaped hinge body defining a second plane, the hinge body being anchorable to the one of the door or the stationary support structure so that the first plane and the second plane are coincident or parallel to each other, the hinge body including an inner surface; and a pivot defining a first longitudinal axis parallel to the second plane or lying thereon, the pivot being anchorable to the other one of the door or the stationary support structure, the pivot and the hinge body being reciprocally coupled so as to rotate around the first axis between an opening position and a closing position, wherein the hinge body includes a lateral opening and a closing element for closing the lateral opening, the inner surface of the hinge body and the closing element reciprocally cooperating to define a working chamber extending along a second longitudinal axis perpendicular to the first axis, wherein the working chamber includes a front wall, a bottom wall and a slider sliding along the second axis between a position distal from the bottom wall and a position proximal thereto, the working chamber further including a first pair of guiding facing walls and a second pair of guiding facing walls interacting or in reciprocal contact with the slider, the hinge body comprising the first pair of guiding facing walls, the closing element comprising at least one of the guiding facing walls of the second pair, and wherein the pivot further includes a cam element integrally rotatable therewith, the slider comprising an operative face interacting with the cam element so as upon the opening or the closing of the door a rotation of the pivot around the first axis corresponds to the sliding of the slider along the second axis from the distal to the proximal position, the working chamber further comprising an elastic member interposed between the bottom wall of the working chamber and the slider to act on the slider so as to move the slider from the proximal to the distal position.

16. The low-bulkiness hinge according to claim 15, wherein the elastic member has an outer diameter equal to a thickness of the hinge body.

17. The low-bulkiness according to claim 15, wherein the cam element of the pivot has an substantially parallelepiped shape with a first surface disposed to come in contact with an operative face of the slider when the slider is in the distal position and a second surface disposed to come in contact with the operative face of the slider when the slider is in the proximal position, the first and second surfaces being reciprocally transverse.

18. The low-bulkiness according to claim 17, wherein the first surface and the second surface are substantially flat, the operative face being substantially flat.

19. The low-bulkiness according to claim 18, wherein the first and second surface are substantially perpendicular to each other, the cam element of the pivot having an substantially rectangular parallelepiped shape, and wherein, when the slider is in the proximal position, the first and second surfaces are respectively substantially perpendicular and parallel to the operative face, and, when the slider is in the distal position, the first and second surfaces are respectively substantially parallel and perpendicular to the operative face.

20. The low-bulkiness according to claim 19, wherein the elastic member is a coil spring that has a maximum compression in the proximal position, the second surface of the cam element including a shock-absorbing portion adapted to interact with the slider to compress the coil spring from the maximum compression when a user imparts a further rotation the door from the open position toward a direction opposite to the closed position, the coil spring shock-absorbing the further rotation, the cam element including a third surface substantially perpendicular to the second surface and substantially parallel to the first surface, the shock absorbing portion being interposed between the second and the third surface.

* * * * *